US007620466B2

(12) United States Patent
Neale et al.

(10) Patent No.: US 7,620,466 B2
(45) Date of Patent: Nov. 17, 2009

(54) SPORTING EVENT STATISTICS TRACKING AND COMPUTATION SYSTEM AND METHOD

(75) Inventors: Stuart Neale, Manchester, MO (US); Gregory Neale, Manchester, MO (US); Benjamin C. Gilman, Huntersville, NC (US)

(73) Assignee: Wellspring Software, Manchester, MO (US)

( * ) Notice: Subject to any disclaimer, the term of this patent is extended or adjusted under 35 U.S.C. 154(b) by 847 days.

(21) Appl. No.: 10/784,635

(22) Filed: Feb. 23, 2004

(65) Prior Publication Data

US 2005/0187644 A1 Aug. 25, 2005

(51) Int. Cl.
*A63F 9/24* (2006.01)

(52) U.S. Cl. ..... 700/91

(58) Field of Classification Search ..... 700/91, 700/92; 463/36

See application file for complete search history.

(56) References Cited

U.S. PATENT DOCUMENTS 5,118,105 A * 6/1992 Brim et al. ..... 473/58
5,198,976 A * 3/1993 Form et al. ..... 700/91
5,507,485 A * 4/1996 Fisher ..... 473/407
5,593,349 A * 1/1997 Miguel et al. ..... 463/30
6,041,266 A * 3/2000 Nickerson ..... 700/92
6,148,242 A * 11/2000 Descalzi et al. ..... 700/90
6,631,522 B1 * 10/2003 Erdelyi ..... 725/53
6,710,713 B1 * 3/2004 Russo ..... 340/573.1
2002/0049507 A1 4/2002 Hameen-Anttila
2002/0138163 A1 9/2002 MacPherson
2002/0143790 A1 10/2002 Qian
2003/0054905 A1 3/2003 King, Jr.
2003/0112354 A1 * 6/2003 Ortiz et al. ..... 348/333.01
2005/0075153 A1 * 4/2005 Valero Moreno ..... 463/1

* cited by examiner

*Primary Examiner*—Dmitry Suhol
*Assistant Examiner*—Jasson H Yoo
(74) *Attorney, Agent, or Firm*—Haverstock Roberts LLP

(57) ABSTRACT

A computerized tracking system including hardware, software and data collection devices used to deduce events and accumulate statistics about a sporting event. Events and statistics are accumulated based on tracking possession of the ball, or primary object of play. In addition to gathering statistics based on the possession of the ball, the system will also include a method of accumulating additional game statistics by logging specific game events.

22 Claims, 27 Drawing Sheets

Pierce College Varsity Men

1000

Sunday, November 09, 2003 3:00 PM

Pierce College @ ELA

| # | Player | Min | Pos | FG | FG-Pct | 3 FG | 3-Pct | FT | FT-Pct | Pts | Off | Def | Rebs | PF | Ast | Blk | TO | Stl |
|---|---|---|---|---|---|---|---|---|---|---|---|---|---|---|---|---|---|---|
| 1 | S. Allison | 35:34 | 2:52 | 5-16 | .313 | 0-2 | .000 | 1-2 | .500 | 11 | 0 | 1 | 1 | 2 | 1 | 1 | 7 | 1 |
| 3 | P. Simon | 20:48 | 3:31 | 0-2 | .000 | 0-1 | .000 | 2-4 | .500 | 2 | 0 | 0 | 0 | 5 | 1 | 0 | 4 | 2 |
| 4 | S. Thomas | 5:59 | :58 | 1-4 | .250 | 0-2 | .000 | 2-2 | 1.000 | 4 | 0 | 0 | 0 | 2 | 1 | 0 | 0 | 0 |
| 5 | C. Larkins | 12:48 | 1:44 | 0-0 | .000 | 0-0 | .000 | 3-4 | .750 | 3 | 0 | 2 | 2 | 3 | 1 | 2 | 1 | 1 |
| 10 | M. Asghari | 9:01 | 1:22 | 2-4 | .500 | 1-2 | .500 | 0-0 | .000 | 5 | 0 | 2 | 2 | 1 | 1 | 0 | 3 | 1 |
| 24 | G. Bernard | 16:24 | 1:14 | 1-4 | .250 | 0-2 | .000 | 2-3 | .667 | 4 | 0 | 3 | 3 | 0 | 1 | 0 | 3 | 1 |
| 30 | B. Haywood | 2:47 | :00 | 0-0 | .000 | 0-0 | .000 | 0-0 | .000 | 0 | 0 | 1 | 1 | 2 | 0 | 0 | 1 | 0 |
| 34 | K. Johnson | 23:37 | :31 | 1-1 | 1.000 | 0-0 | .000 | 1-1 | 1.000 | 3 | 2 | 7 | 9 | 0 | 0 | 1 | 0 | 0 |
| 35 | J. Harris | 18:28 | :17 | 2-4 | .500 | 0-0 | .000 | 0-0 | .000 | 4 | 2 | 0 | 2 | 4 | 0 | 2 | 1 | 0 |
| 42 | B. Duplessie | 14:22 | :29 | 3-4 | .750 | 0-0 | .000 | 4-5 | .800 | 10 | 0 | 2 | 2 | 4 | 0 | 0 | 0 | 0 |
| 44 | M. Castraneda | 11:09 | :11 | 1-3 | .333 | 0-0 | .000 | 0-0 | .000 | 2 | 2 | 2 | 4 | 0 | 0 | 0 | 0 | 0 |
| 54 | H. Aubrey | 29:03 | 2:56 | 4-11 | .364 | 1-5 | .200 | 4-6 | .667 | 13 | 1 | 2 | 3 | 4 | 0 | 0 | 4 | 0 |
| | Team | | 16:05 | 20-53 | .377 | 2-14 | .143 | 19-27 | .704 | 61 | 7 | 22 | 29 | 27 | 6 | 6 | 24 | 6 |

1020

Legend
- P. Simon
- H. Aubrey
- S. Allison
- C. Larkins
- M. Asghari
- G. Bernard
- S. Thomas
- K. Johnson Total 16:06

1030

1010

1000

Pierce College Varsity Men

Sunday, November 09, 2003 3:00 PM

Pierce College @ ELA

| # | Player | Min | Pos | FG | FG-Pct | 3 FG | 3-Pct | FT | FT-Pct | Pts | Off | Def | Rebs | PF | Ast | Blk | TO | Stl |
|---|---|---|---|---|---|---|---|---|---|---|---|---|---|---|---|---|---|---|
| 1 | S. Allison | 35:34 | 2:52 | 5-16 | .313 | 0-2 | .000 | 1-2 | .500 | 11 | 0 | 1 | 1 | 2 | 1 | 1 | 7 | 1 |
| 3 | P. Simon | 20:48 | 3:31 | 0-2 | .000 | 0-1 | .000 | 2-4 | .500 | 2 | 0 | 0 | 0 | 5 | 1 | 0 | 4 | 2 |
| 4 | S. Thomas | 5:59 | :58 | 1-4 | .250 | 0-2 | .000 | 2-2 | 1.000 | 4 | 0 | 0 | 0 | 2 | 1 | 0 | 0 | 0 |
| 5 | C. Larkins | 12:48 | 1:44 | 0-0 | .000 | 0-0 | .000 | 3-4 | .750 | 3 | 0 | 2 | 2 | 3 | 1 | 2 | 1 | 1 |
| 10 | M. Asghari | 9:01 | 1:22 | 2-4 | .500 | 1-2 | .500 | 0-0 | .000 | 5 | 0 | 2 | 2 | 1 | 1 | 0 | 3 | 1 |
| 24 | G. Bernard | 16:24 | 1:14 | 1-4 | .250 | 0-2 | .000 | 2-3 | .667 | 4 | 0 | 3 | 3 | 0 | 1 | 0 | 3 | 1 |
| 30 | B. Haywood | 2:47 | :00 | 0-0 | .000 | 0-0 | .000 | 0-0 | .000 | 0 | 0 | 1 | 1 | 2 | 0 | 0 | 1 | 0 |
| 34 | K. Johnson | 23:37 | :31 | 1-1 | 1.000 | 0-0 | .000 | 1-1 | 1.000 | 3 | 2 | 7 | 9 | 0 | 0 | 1 | 0 | 0 |
| 35 | J. Harris | 18:28 | :17 | 2-4 | .500 | 0-0 | .000 | 0-0 | .000 | 4 | 2 | 0 | 2 | 4 | 0 | 2 | 1 | 0 |
| 42 | B. Duplessie | 14:22 | :29 | 3-4 | .750 | 0-0 | .000 | 4-5 | .800 | 10 | 0 | 2 | 2 | 4 | 0 | 0 | 0 | 0 |
| 44 | M. Castraneda | 11:09 | :11 | 1-3 | .333 | 0-0 | .000 | 0-0 | .000 | 2 | 2 | 2 | 4 | 0 | 0 | 0 | 0 | 0 |
| 54 | H. Aubrey | 29:03 | 2:56 | 4-11 | .364 | 1-5 | .200 | 4-6 | .667 | 13 | 1 | 2 | 3 | 4 | 0 | 0 | 4 | 0 |
| | Team | | 16:05 | 20-53 | .377 | 2-14 | .143 | 19-27 | .704 | 61 | 7 | 22 | 29 | 27 | 6 | 6 | 24 | 6 |

FIG. 16A

#1 Sylverter Allison

Sunday, November 09, 2003 3:00 PM

Pierce College @ ELA

| | Min | Pos | FG | FG-Pct | 3 FG | 3-Pct | FT | FT-Pct | Pts | Off | Def | Rebs | PF | Ast | Blk | TO | Stl |
|---|---|---|---|---|---|---|---|---|---|---|---|---|---|---|---|---|---|
| First Half | 20:00 | 1:49 | 5-9 | .556 | 0-2 | .000 | 1-2 | .500 | 11 | 0 | 0 | 0 | 2 | 1 | 0 | 7 | 0 |
| Second Half | 15:34 | 1:03 | 0-7 | .000 | 0-0 | .000 | 0-0 | .000 | 0 | 0 | 1 | 1 | 0 | 0 | 1 | 0 | 1 |
| Total | 35:34 | 2:52 | 5-16 | .313 | 0-2 | .000 | 1-2 | .500 | 11 | 0 | 1 | 1 | 2 | 1 | 1 | 7 | 1 |

1050

1070

Action Chart

Legend
- Pass
- Shot
- Turnover

Total 53

1080

Passing Chart

Legend
- P. Simon
- H. Aubrey
- K. Johnson
- M. Asghari
- C. Larkins
- G. Bernard
- B. Duplessie
- S. Thomas Total 30

1060

1050

#1 Sylverter Allison

Sunday, November 09, 2003 3:00 PM

Pierce College @ ELA

| | Min | Pos | FG | FG-Pct | 3 FG | 3-Pct | FT | FT-Pct | Pts | Off | Def | Rebs | PF | Ast | Blk | TO | Stl |
|---|---|---|---|---|---|---|---|---|---|---|---|---|---|---|---|---|---|
| First Half | 20:00 | 1:49 | 5-9 | .556 | 0-2 | .000 | 1-2 | .500 | 11 | 0 | 0 | 0 | 2 | 1 | 0 | 7 | 0 |
| Second Half | 15:34 | 1:03 | 0-7 | .000 | 0-0 | .000 | 0-0 | .000 | 0 | 0 | 1 | 1 | 0 | 0 | 1 | 0 | 1 |
| Total | 35:34 | 2:52 | 5-16 | .313 | 0-2 | .000 | 1-2 | .500 | 11 | 0 | 1 | 1 | 2 | 1 | 1 | 7 | 1 |

FIG. 17A

SPORTING EVENT STATISTICS TRACKING AND COMPUTATION SYSTEM AND METHOD

BACKGROUND OF INVENTION

This invention relates generally to collection and dissemination of sporting statistics. More specifically, this invention relates to a system and method of real-time collecting, generating, manipulating, storing, reporting, and disseminating of statistics for a sporting event.

There are many methods of manipulating and presenting sporting statistics known in the art. Most of the known methods, however, collect the data used to process those statistics in similar ways. Individuals watch the sport and record events and information about the players involved in the events, generally after events happen. Even though portions of the process have become automated to some degree, and event recording, in some instances, is performed at times closer to the occurrence of the events, significant event-related information must generally still be provided later, especially in fast-paced sporting events such as basketball, soccer, and hockey. Events are generally still recorded first, followed by later recording of information about the players involved in these events and additional details. Then these recorded events are compiled into statistics. Such methods and systems employed are susceptible to human error, and subject to a delay, even when portions thereof are more automated and closer to real-time.

What is needed, therefore, is a system and method for real-time data collection, manipulation and reporting that is more robust than the traditional systems and methods and which provides traditional statistics as well as desirable, previously unattainable, statistics. There is therefore a need and market for a method that collects sporting event statistics which overcomes the shortcomings of the prior art, especially one that is capable of collecting and providing information and statistics in near real-time.

It is an object of this invention to provide a method of compiling and disseminating sports performance information and statistics accurately in near real-time, and including statistics that have not been readily available before.

Still other objects, advantages, distinctions and alternative constructions and/or combinations of the invention will become more apparent from the following description with respect to the appended drawings. Similar components and assemblies are referred to in the various drawings with similar alphanumeric reference characters. This description should not be literally construed in limitation of the invention. Rather, the invention should be interpreted within the broad scope of the further appended claims.

SUMMARY OF THE INVENTION

The present invention is directed to an interactive, computerized recording and tracking system that includes computer software, associated hardware, and data collection devices used to accumulate information and provide statistics about a sporting event, and a method of use thereof. The method used in the system can principally track the possession of the ball or object of play and events that occur during such tracking, such as a change of possession, a shot, a rebound, a basket, and so forth, in accordance with interactive inputs from a user. The game status of the sporting event at given times and an information entry at such times can be established, consistent with the system programming, the occurrence of a game event which is storable in a database. Certain event entries may be logged and entered into the database independently of ball possession tracking.

The system preferably includes hardware such as a computer, with a keyboard, which may be a lap top computer or another type of device that provides a User Interface, and can operate in accordance with the system software which can have various modules. In a preferred embodiment, as part of the set up for a game, league information, team information, and any available official information may be loaded into or associated with a Game Module. Team information includes, in part, team name, player names and numbers. This information may be downloaded from another source or it can be directly input, such as through the User Interface, prior to the start of each game. During the game, based on the team information, the User Interface is used to identify each player who possesses the ball during play. Each time possession of the ball changes, an information entry is made at the User Interface, such as by making a player identification entry. The possession information, as well as additional game event information, is entered in essentially real-time as the game progresses and corresponding information can be stored in a Database, which may also be part of the system software.

The software may include a Reporting Module that can translate the events stored in the Database into statistics and produce reports that can be distributed to interested observers. Distribution can include displaying the report on a screen, printing it locally, sharing with networked or wired observers, transmitting the report via a wireless network to remote observers or any number of known methods for distributing information. These statistics can be used for real-time analysis by coaches, broadcasters or fans by using networked, wired or wireless devices such as portable computers, tablet computers, PDAs or the like. The statistics can also be used for historical analysis using similar devices, printed reports, or through upload to the internet, making common league statistics publicly available to other interested parties.

Another optional feature of the system is a Video Search Tool that can record the game and time synchronizes the recording with the information stored in the Database. Since the recording may be time synchronized with the game events, the user can identify the starting and ending points for a statistical report, communicate these points to the Reporting Module and create a specialized report based on the time period selected using the Video Search Tool.

Using the team information and the game data, the Game Module can receive the user entries and makes use of real-time possession data to identify events that can then be stored in the Database and can be accessed by the Reporting Module. In addition to the possession information, the user can enter, in real-time mode, game events that cannot be deduced from the ball possession information alone. For example, in a basketball game, fouls, shot attempts, shots made, violations, time outs, player substitutions, and the like require more information than the identity of the player in possession of the ball, and this information along with the events can be entered and stored in the Database. All of the event information can be synchronized with the game data, including a video produced by the Video Search Tool.

An optional Motion Module can collect information related to the movement of the players. Although the Game Module does not require a correlation with the Motion Module, with some Motion Modules it may be possible to track position, possession, and/or the occurrences of certain game events without the necessity of certain inputs by a user. The Motion Module may use a method of tracking the location of players and the primary object of play using an optical, radio, ultrasonic, audio or combined signal based player or object tracking system. The Motion Module can operate independently of, or in coordination with, the Game Module and the data and events collected by the Motion Module may be made available to the Database and the Reporting Module.

The data collected by the Motion Module may include, for example, the instantaneous position on the court of each player and/or object of interest in real-time throughout the game. This information may, in part, be used to calculate speed, distance and jump height associated with each athlete. In addition, at any point in the game, data from the Motion Module can be used to calculate a work factor (XFactor) for each athlete. The XFactor is derived from a combination of the distance, time and acceleration of each athlete for a specified period of time. The position of a player or game object relative to one another or to certain sensors that may be located on or about a field of play of the game can also be determined using the Motion Module.

The Reporting Module can acquire information from the database, the Game Module and the Motion Module to generate reports of many types, including statistical analyses about players, teams, games, and conferences. If the Motion Module is connected to the Reporting Module, the additional data acquired from the Motion Module can be used to create reports including statistical analyses that include information about location, speed, distance and effort (measured by the XFactor). The Reporting Module can be used with the Game Module to produce reports. Local reports can be produced to reflect only data from individual games stored on the local computer. These reports can be made available to a wider regional database or to the internet. Functions similar to those of the Reporting Module can also reside on an internet website which can upload game events logged by the Game Module and then allow users to view reports that reflect individual games as well as season statistics for the team and for each player. The system can allow users to automatically upload data collected by the Game Module and the Motion Module to generate reports of statistics about players, teams and conferences.

These statistics may be viewed and reports may be generated and viewed or printed at any station that can access the system. These reports can be generated based on a period of the game, based on the clock time, or based on the beginning and the end of a game sequence identified using the Video Search Tool. Any station with access to the system can view a report as a static time delimited report or as a dynamic report with a defined starting point and dynamic statistics updated as the game advances. Reports may be displayed numerically or graphically. Using a display associated with the User Interface, a report can be viewed or it can be printed from hardware associated with the User Interface. In addition, a video produced by the Video Search Tool can be reviewed and a report can be generated using a starting and ending point selected from the Video Search Tool.

At least certain aspects of the Game Module and the Motion Module will typically be associated with a local computer at or near the site of the game. Other elements may, depending upon user desires and requirements, be located either locally or remotely. Accordingly, for example, the Database can be located and maintained at a location remote from the game site.

BRIEF DESCRIPTION OF THE DRAWINGS

FIGS. 16, 16A, 16B and 16C is a sample report, with individual parts enlarged, for a team produced by one embodiment of the invention as used during a basketball game.

FIGS. 17, 17A, 17B and 17C is a sample report, with individual parts enlarged, for an individual produced by one embodiment of the invention as used during a basketball game.

DETAILED DESCRIPTION OF THE INVENTION

Figure 1:
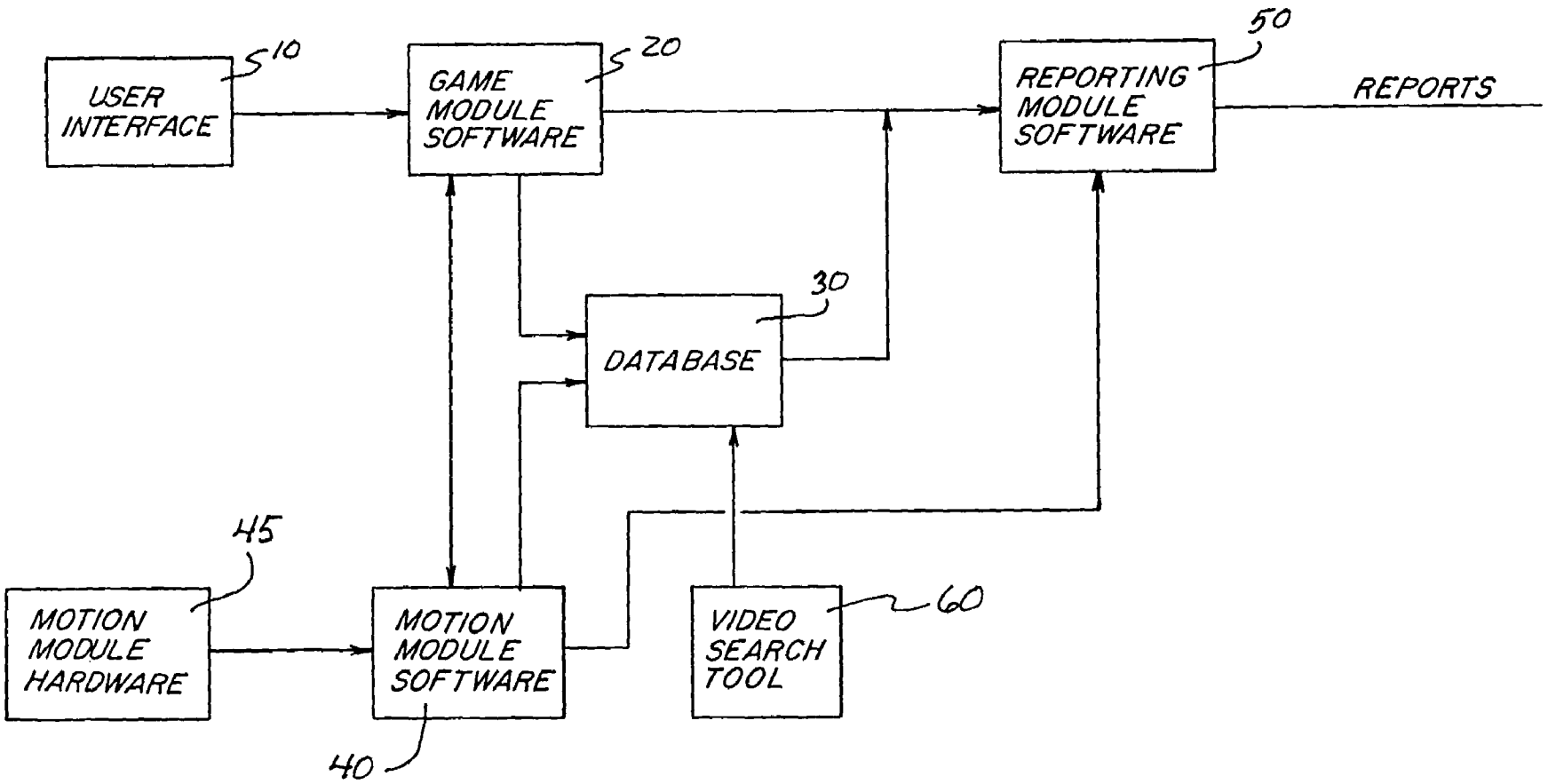
FIG. 1 shows a diagram of a preferred embodiment of a sports statistics generating system constructed according to the present invention, depicting the relationship between various components of the system.

The system described herein can be used for a variety of sports. By way of example, a preferred embodiment of the system is described as it can be used for a basketball game. FIG. 1 shows a diagram of a presently preferred form of the invention, depicting the relationship between various components of the system. The system has a User Interface 10 and software that can include a Game Module 20, a Reporting Module 50, and a Motion Module 40 with related Motion Module Hardware 45. Further, game related information can be stored in a Database 30, and the system will preferably have an associated Data Communications Device having data transfer capability wherein game data can be sent to other users through a wired or wireless network, the internet, or some other known method. A Video Search Tool 60 can create a recording of the game in time synchronization with the game data in the Database 30.

The Game Module 20 is the center of the system because it receives the real-time input of game activity as it occurs and translates that activity into game events. A user inputs game information from a User Interface 10, which can be a laptop computer, a keypad, a touch screen, an audio responsive system, a cellular phone, or the like. The User Interface 10 does not require a display, however, the preferred embodiment as described herein includes a display. When the invention is practiced using a display, the user can be prompted for input appropriate to a particular game situation by the Game Module 20. The software in the Game Module 20 can also indicate an allowable or active choice with highlighted text, while an unallowable or inactive choice can be shown in shadow.

Figure 2:
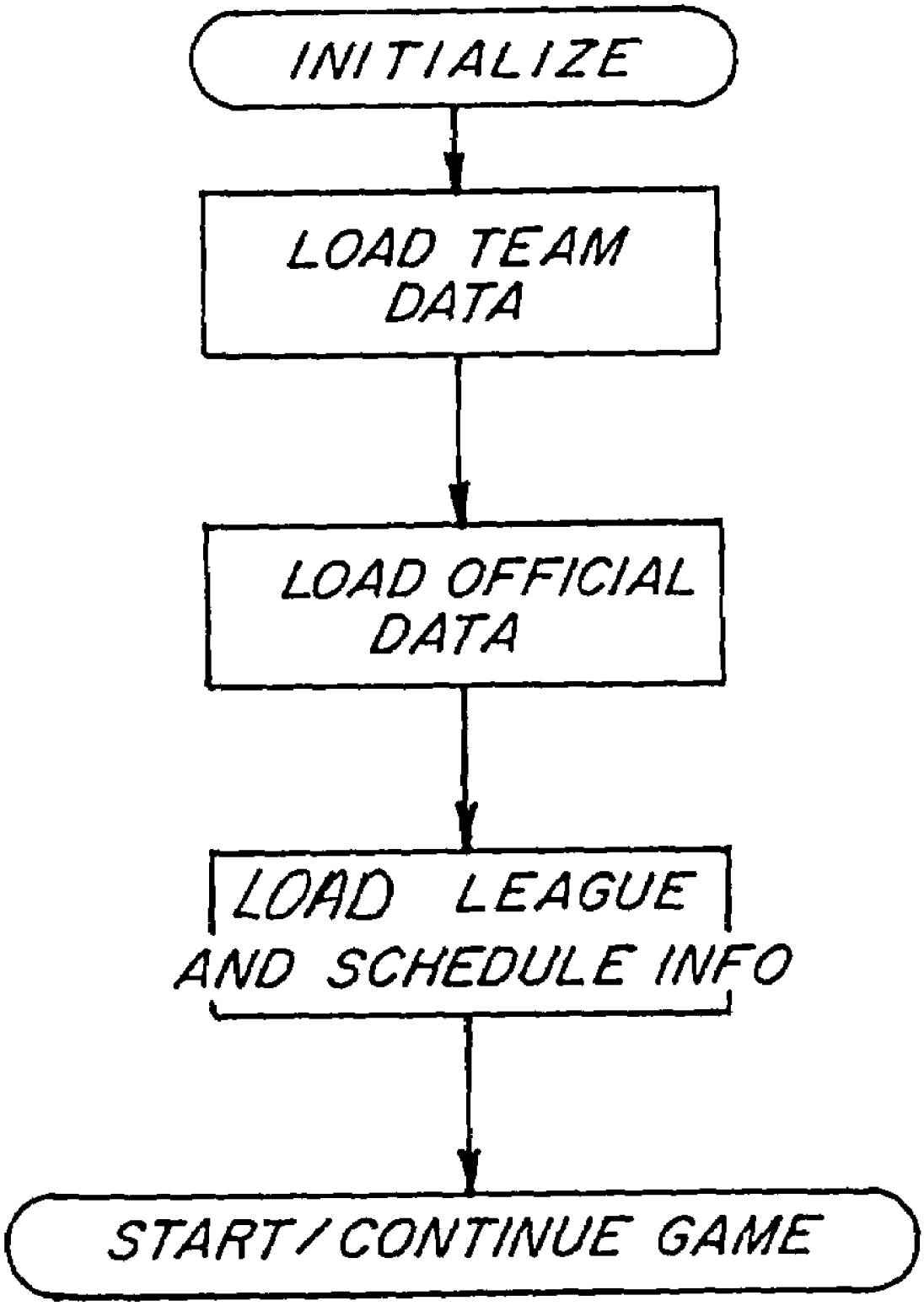
FIG. 2 is an Initialization flow diagram for use in one embodiment of the invention as used in a basketball game.
Figure 3:
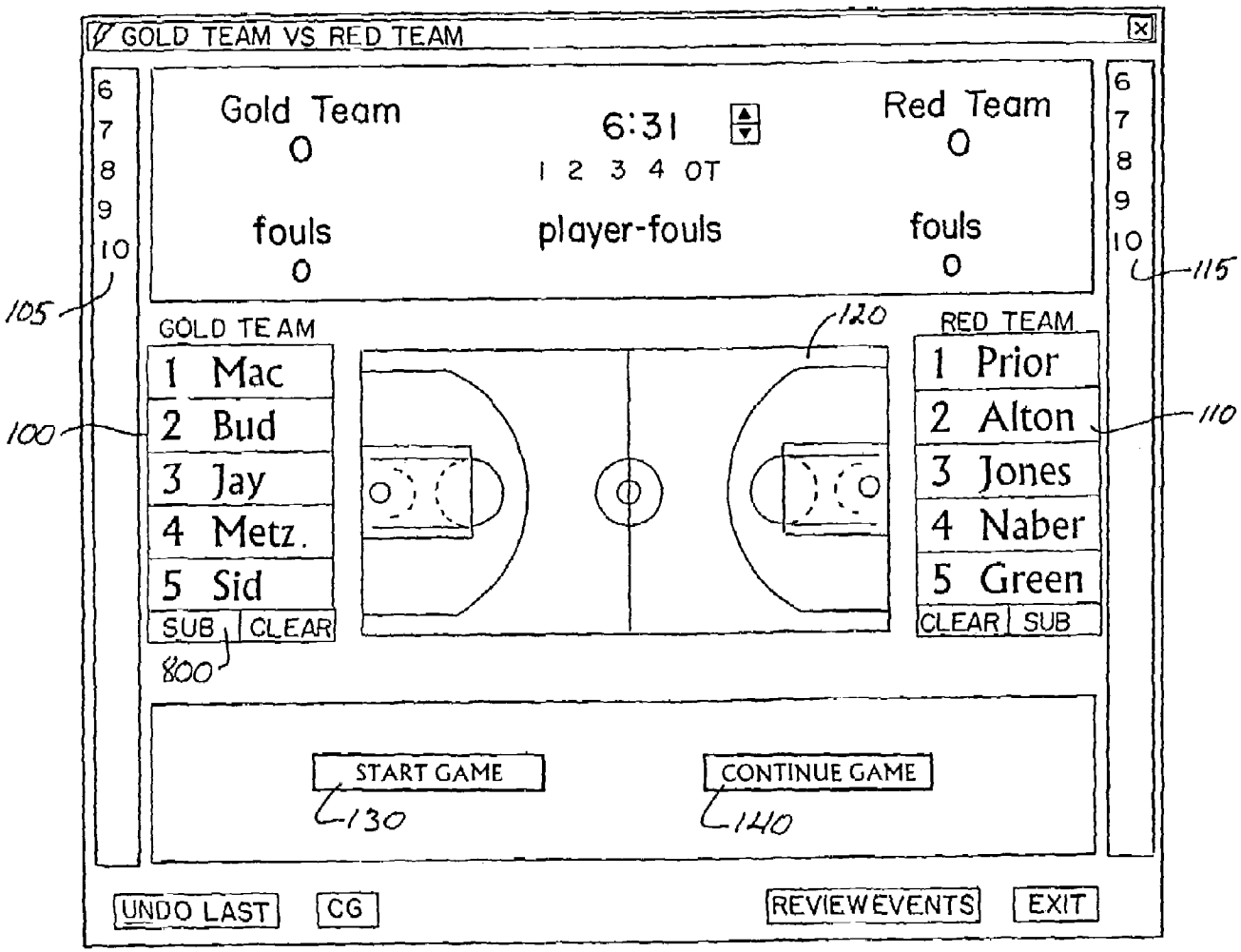
FIG. 3 is a representative Home Screen displayed prior to the start of play of the system as used in one embodiment of the invention as used during a basketball game.

The Game Module 20 can initialize the system as shown in the flow diagram of FIG. 2. FIG. 2 depicts an embodiment of an initialization routine that can be used at the start of a game. The team data 70, including team name, player names and numbers is entered as well as the officials' data 80. In addition, the league and schedule information 90 can be loaded. The team, official, league and schedule data can be downloaded from an existing source or manually entered at the User Interface 10 or through any other acceptable input entry mechanism prior to each game. After initialization for a basketball game example, the user can select five players from each team that will be designated as active players. The ten names and their corresponding jersey numbers can be viewed on a display associated with the User Interface 10. A sample Home Screen produced by the Game Module 20 and shown in FIG. 3 includes the home team players in the game 100 and on the bench 105, on one side of a graphic of a basketball court 120, and the visiting team players in the game 110 and on the bench 115, on the other side of the court 120. When the teams switch sides of the court at half time the Game Module 20 can switch sides of the court on which each team is displayed to make the Home Screen literally match the game, thereby making it easier to enter the second half game activities.

Figure 4:
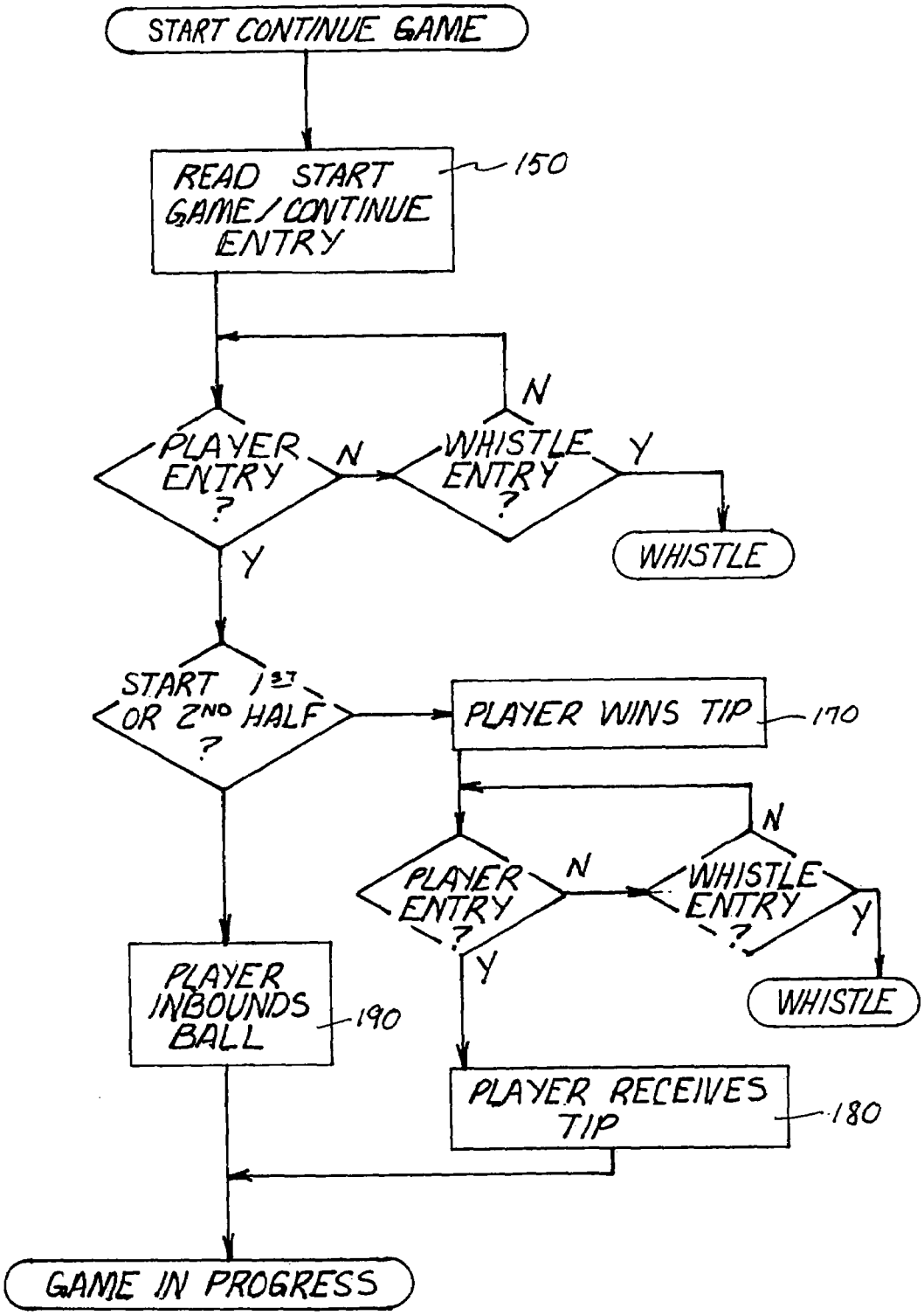
FIG. 4 is a representative Home Screen display of the system for one embodiment of the invention as used during a basketball game prior to tip-off.
Figure 5:
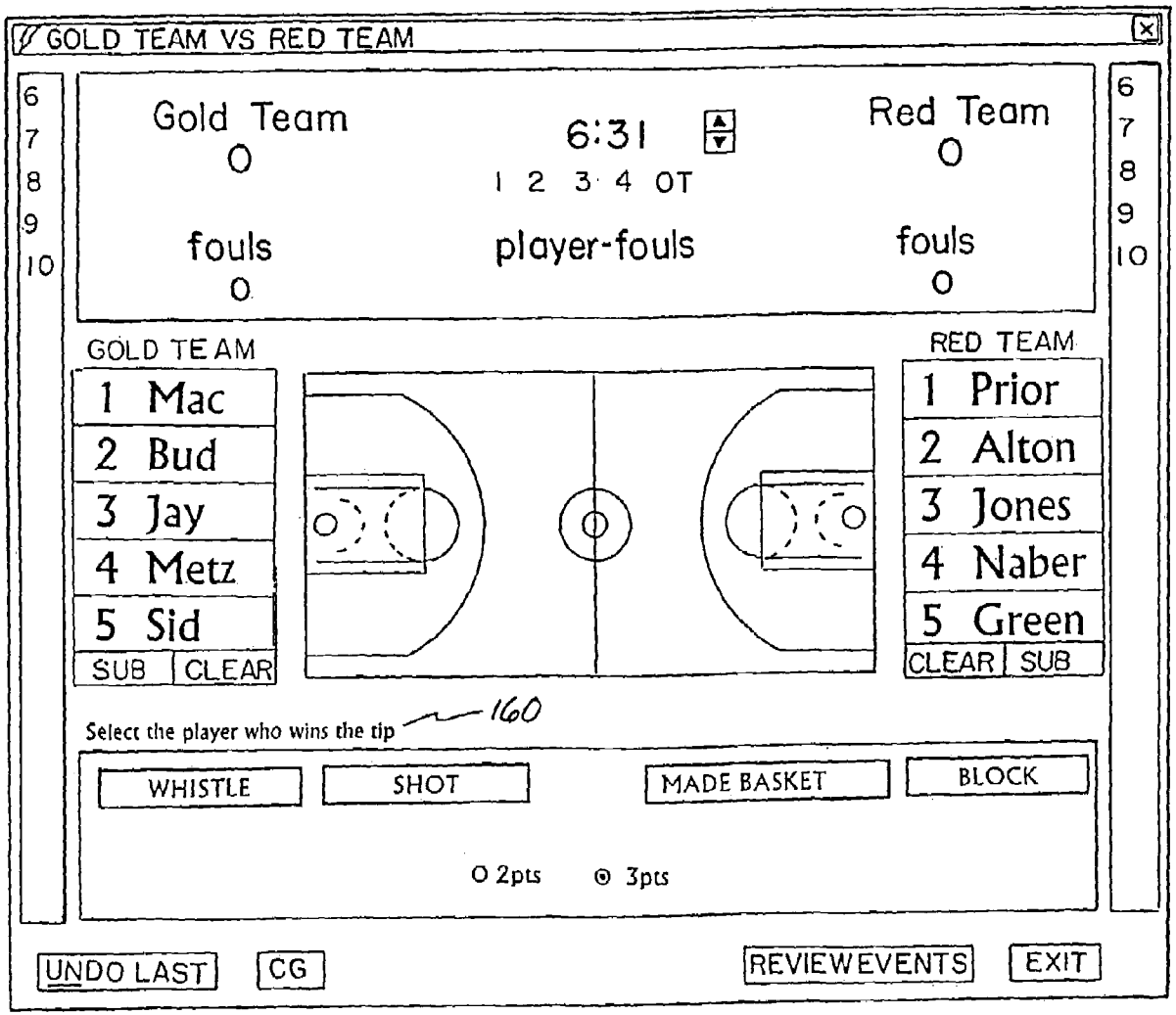
FIG. 5 is a Start/Continue Game flow diagram for use in one embodiment of the invention as used during a basketball game.
Figure 6:
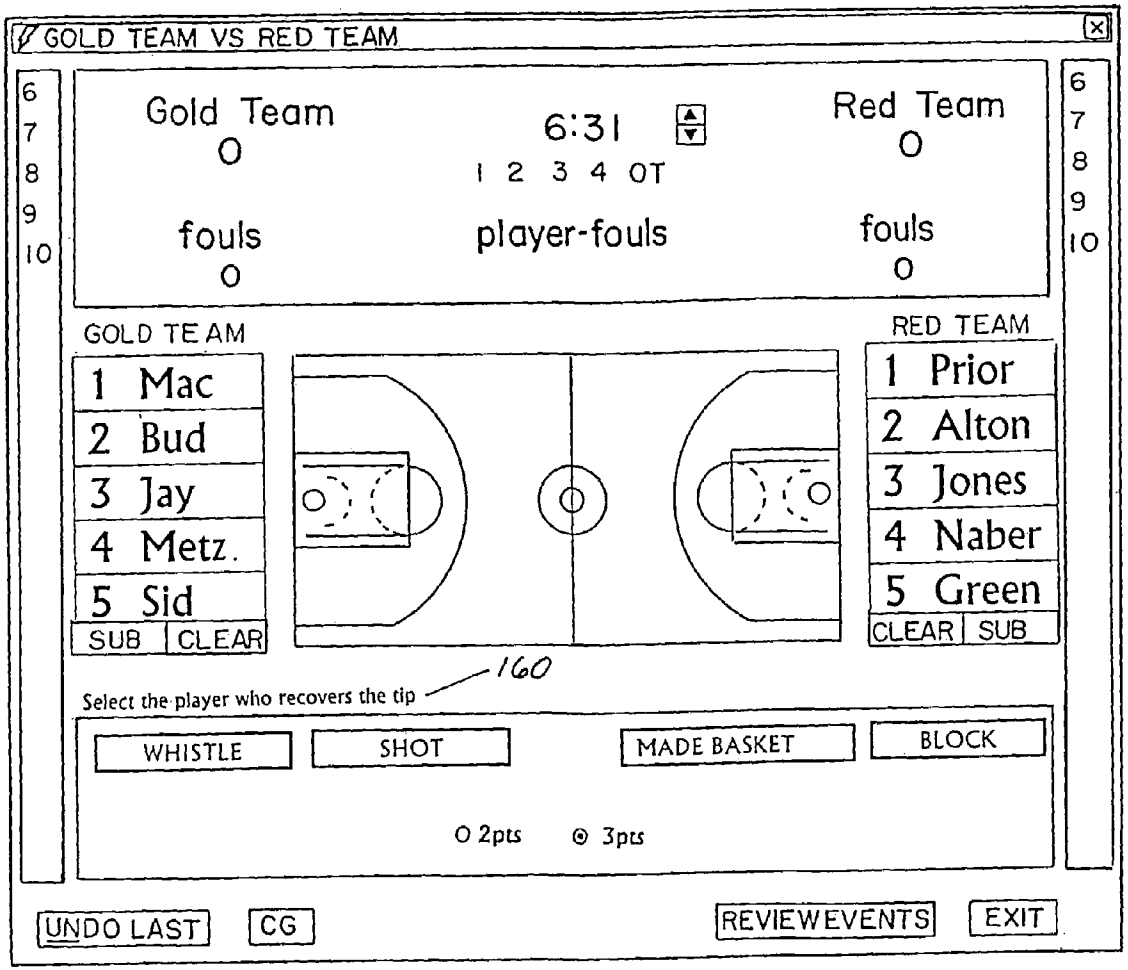
FIG. 6 is a representative Home Screen display of the system for one embodiment of the invention as used during a basketball game wherein the user prompt line directs the user to select the player who receives the tip.

To begin the game, the user selects Start Game 130. To resume play, the user selects Continue Game 140. FIG. 4 depicts a flow diagram that can be used at the start of a game or quarter in an embodiment of the system. The system can determine the game status based on the user entry indicating a Start Game 130 or Continue Game 140 at block 150. For this example the game is at the beginning. FIG. 5 shows the Home Screen display after Start Game 130 is selected. The user is prompted to select the player who wins the tip at a user prompt line 160. Once the player winning the tip is selected, the system credits the selected player for winning the tip at block 170 and waits for the next input. FIG. 6 shows a Home Screen display wherein the user prompt line 160 directs the user to select the player who receives the tip. Once the player receiving the tip is indicated, the system credits that player with receiving the ball at block 180, and the system waits for the next player entry. If the Continue Game 140 had been chosen, the user could have selected the player inbounding the ball, and the system could have credited the player as inbounding the ball at block 190. Each time a new player takes possession of the ball, the user selects the new player. The user may select players by typing jersey numbers using the key pad or by selecting the player's name with a mouse, stylus or touch screen or by an audio indication. The Game Module 20 can translate the indications of possessions of the ball into events, such as a pass or a steal, in the game.

Figure 7:
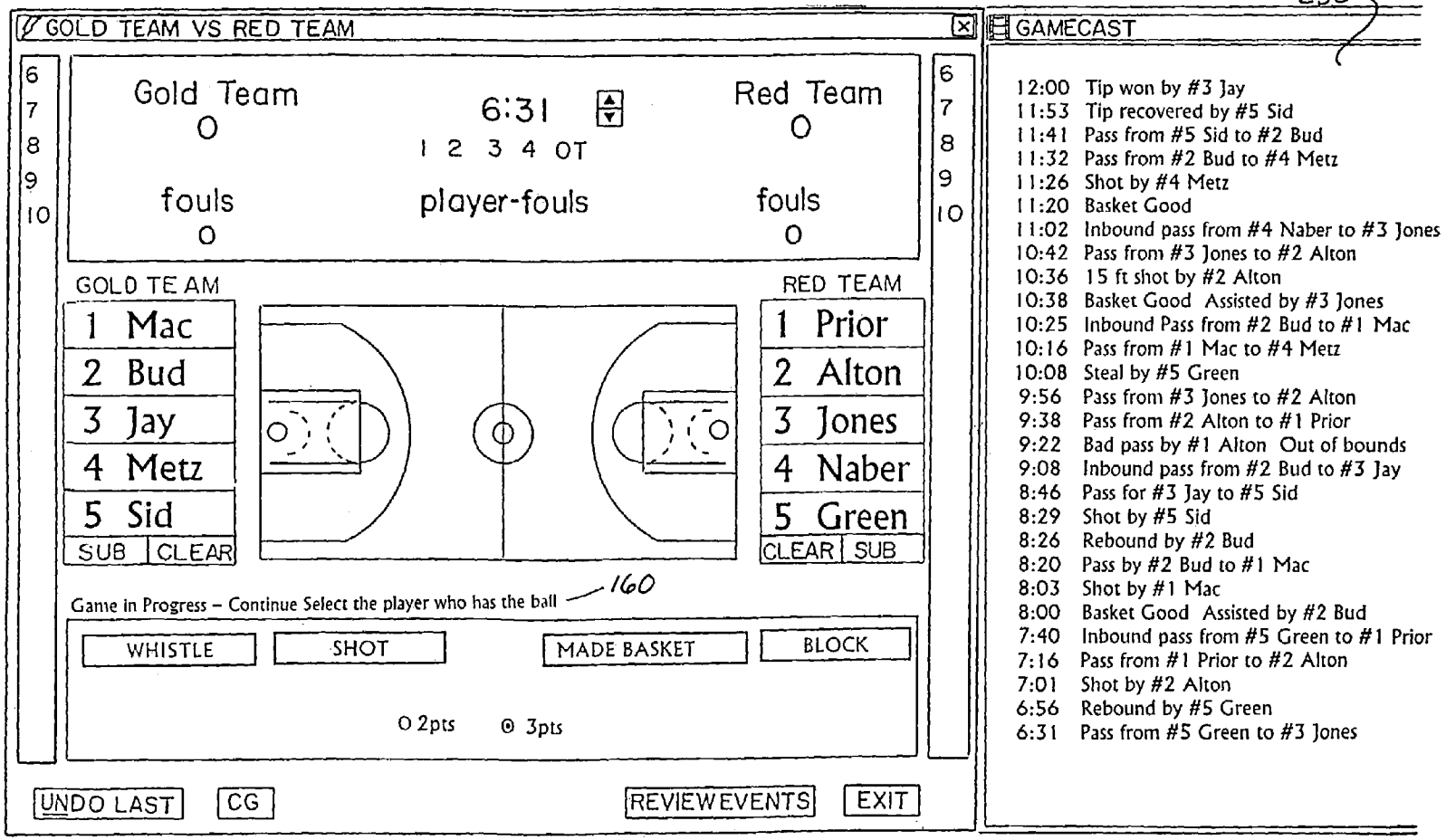
FIG. 7 is a representative Home Screen display of the system for one embodiment of the invention as used during a basketball game wherein the user prompt line directs the user to select the player who has the ball.
Figure 8:
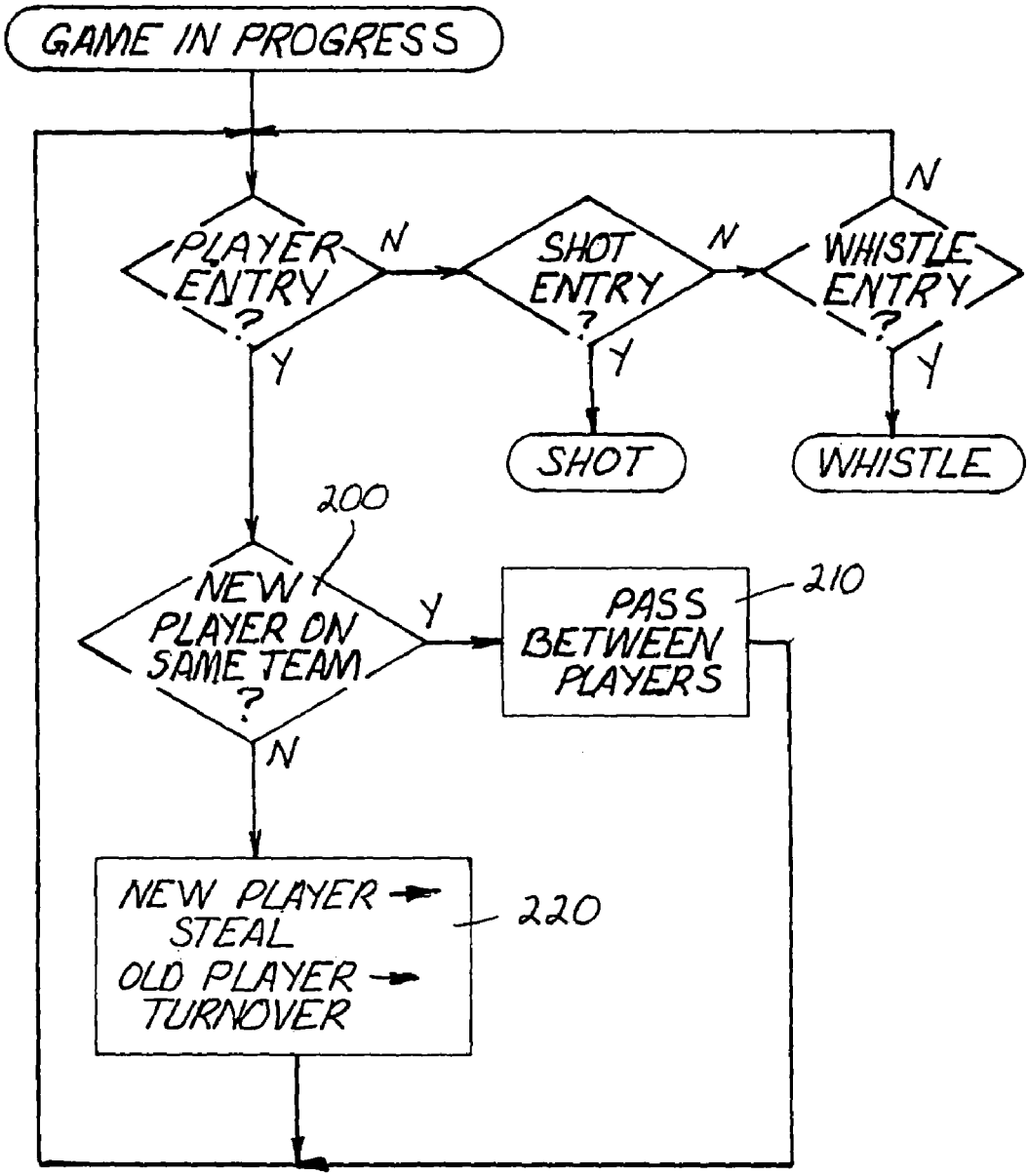
FIG. 8 is a Game in Progress flow diagram that translates possession information into game events for use in one embodiment of the invention as used during a basketball game.

During the game, the Home Screen display user prompt line 160 can direct the user to select the player who has the ball as shown in FIG. 7. FIG. 8 shows the game in progress process flow diagram that translates the possession information into game events. When a player in possession of the ball is entered, the system can compare the team of the player that previously had the ball with the team of the player that currently has the ball as shown in block 200. If the newly selected player in possession of the ball is on the same team as the previous player in possession of the ball, the previous player is credited with a pass to the new player as shown in block 210. If the new player in possession with the ball is on the opposing team, however, the previous player is charged with a turnover and the new player is credited with a steal as shown in block 220. The system deduces the events pass, turnover and steal based on the input stream of players in possession of the ball. These game events can be displayed in a text window 250 as a running description of the game as shown in FIG. 7. Each time the user selects a new player, the Game Module 20 will deduce that the ball has been passed to or stolen by the new player based on the team affiliation of the previous player in possession of the ball as compared to the present player in possession of the ball.

Figure 9:
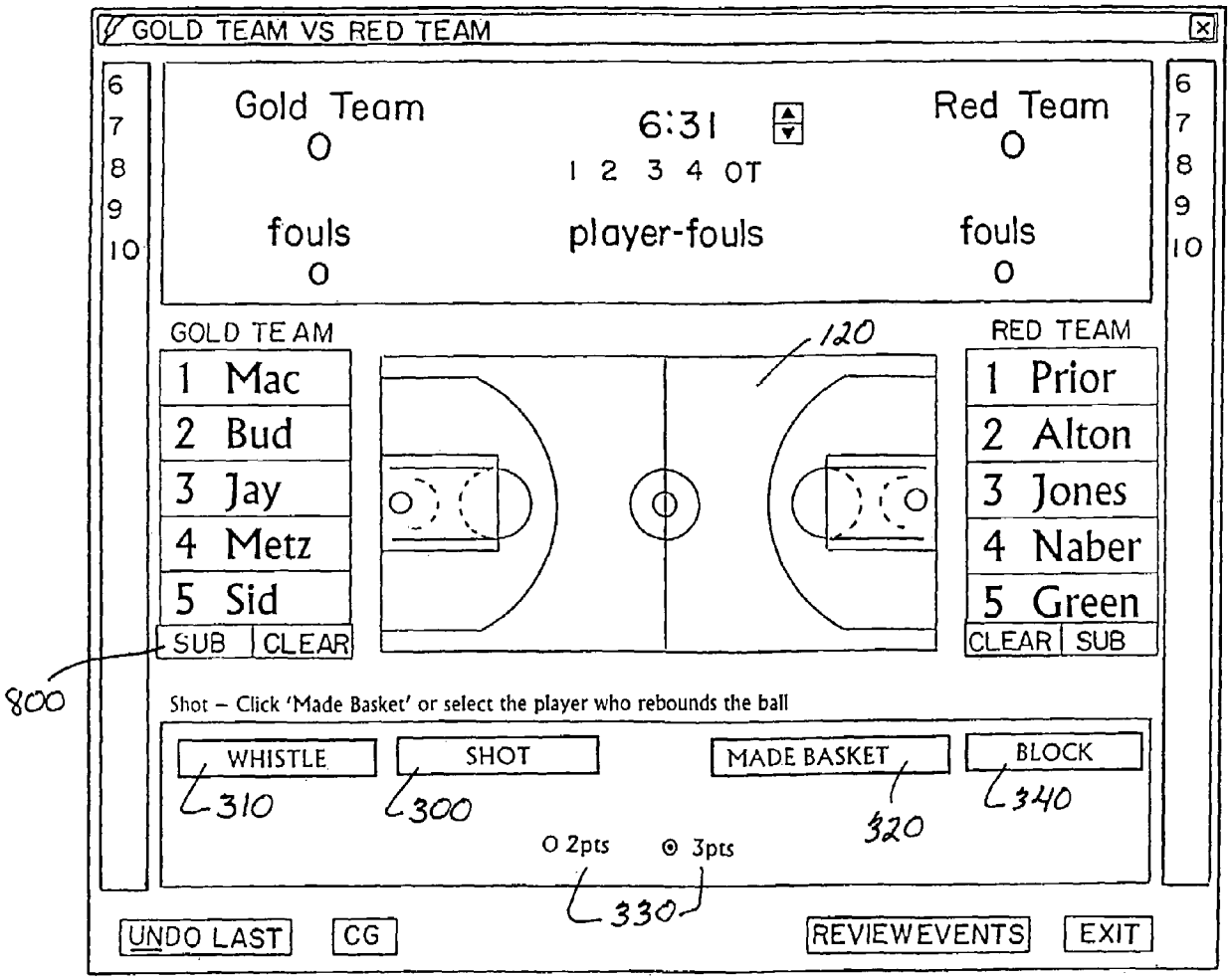
FIG. 9 is a representative Home Screen display of the system for one embodiment of the invention as used during a basketball game wherein the user can indicate the occurrence of a shot or whistle.
Figure 10A:
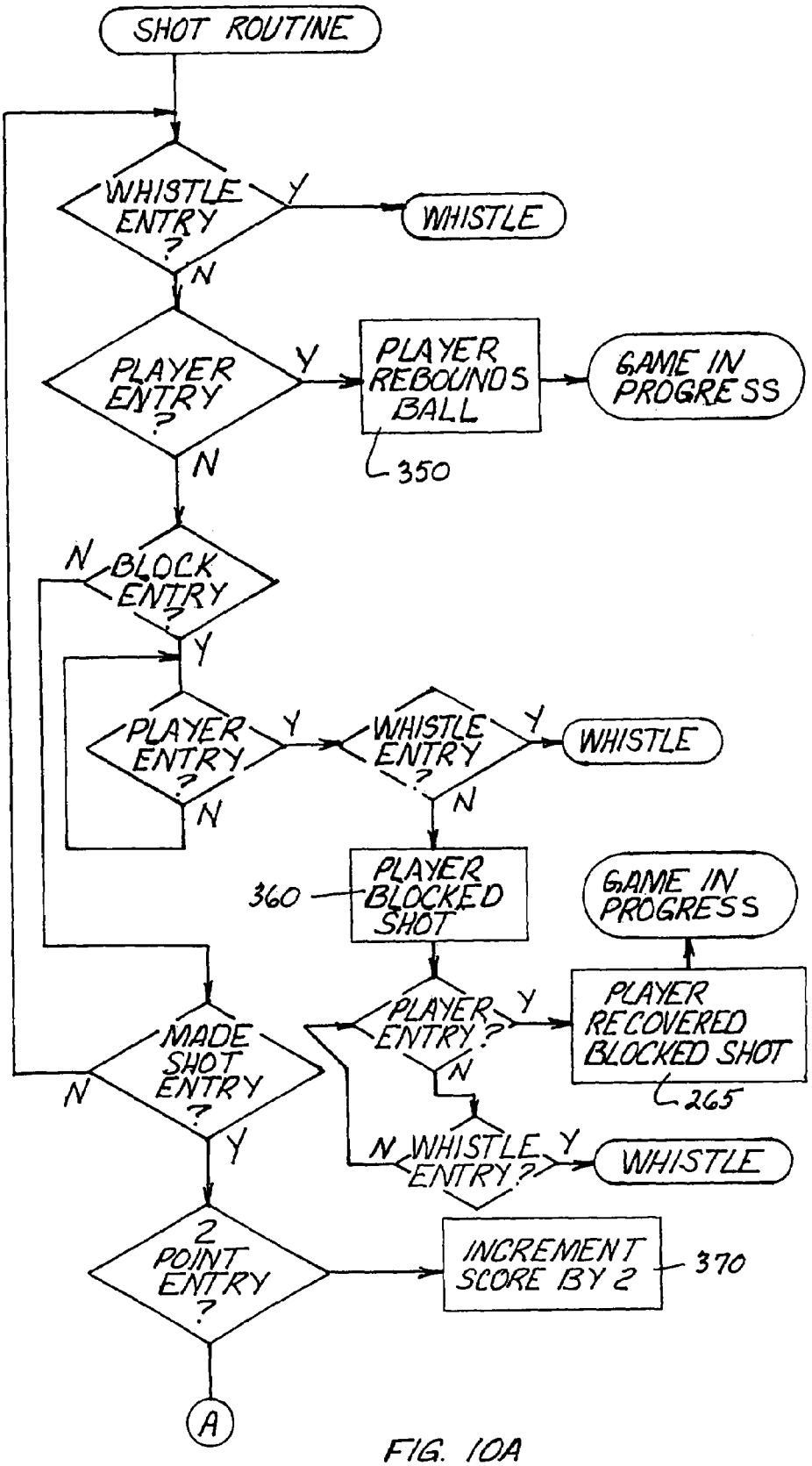
FIGS. 10A and 10B depict an embodiment of a Shot flow diagram for use in one embodiment of the invention as used during a basketball game.
Figure 10B:
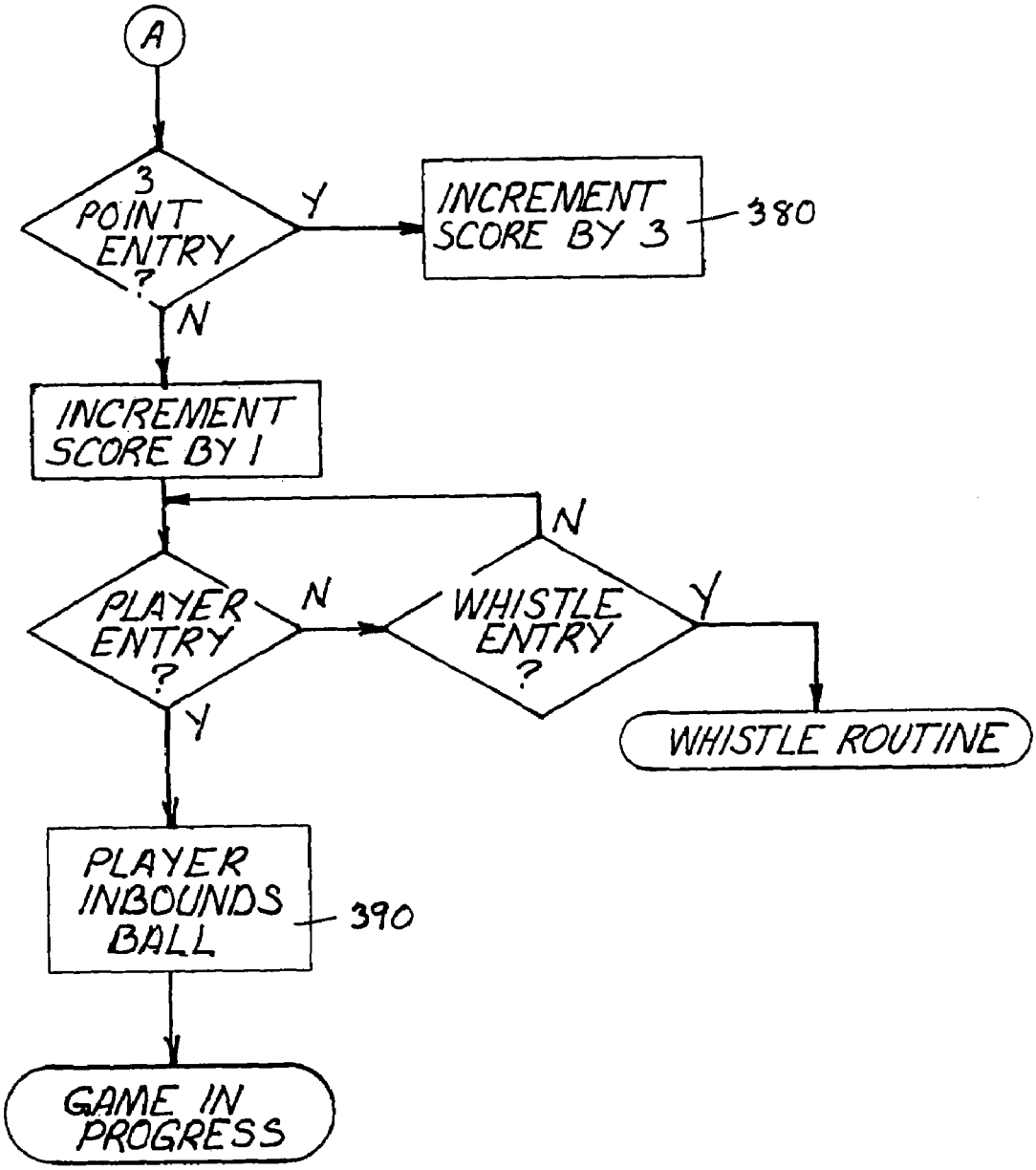

In addition to selecting the player in possession of the ball, the user can indicate the occurrence of a Shot 300 or Whistle 310 as shown in FIG. 9. The user indicates a shot has been made by selecting Shot 300 or by selecting the position on the court graphic 120 from which the player shot. Once a shot has been indicated, the Game Module 20 activates the selections Made Basket 320, 2 or 3 Point 330, and Block 340 as shown in FIG. 9. The flow diagram of FIGS. 10A and 10B depict the general process that can be followed after a shot has been indicated. After a shot, if the next selection is a player, the Game Module 20 assumes the shot was missed, and the selected player with possession of the ball is credited with a rebound as shown in block 350. The system can then deactivate the Made Basket 190 and 2 or 3 Point 210 choices, and the user can continue to indicate the player in possession of the ball wherein the player in possession entries are translated into passes and turnovers as described in FIG. 8. If the shot was blocked, the user selects Block 200 and then selects the player who blocked the shot. The selected player is credited with the block in block 360, and the next player entered is credited with recovering the blocked shot as shown in block 365. Then the user can continue to indicate the player in possession of the ball wherein the player in possession entries are translated into passes and turnovers as described in FIG. 8. If the shot was successful, however, the user can select Made Basket 190 and accept or override the 2 or 3 Point 210 selection made by the Game Module based upon the position on the court from which the shot was made. The system can increment the score by the appropriate points as shown in blocks 370 or 380. After a score, the user indicates the inbounding player, that player is credited with an inbound at block 390, and the user can continue to indicate the player in possession of the ball wherein the player in possession entries are translated into passes and turnovers as described in FIG. 8.

Figure 11:
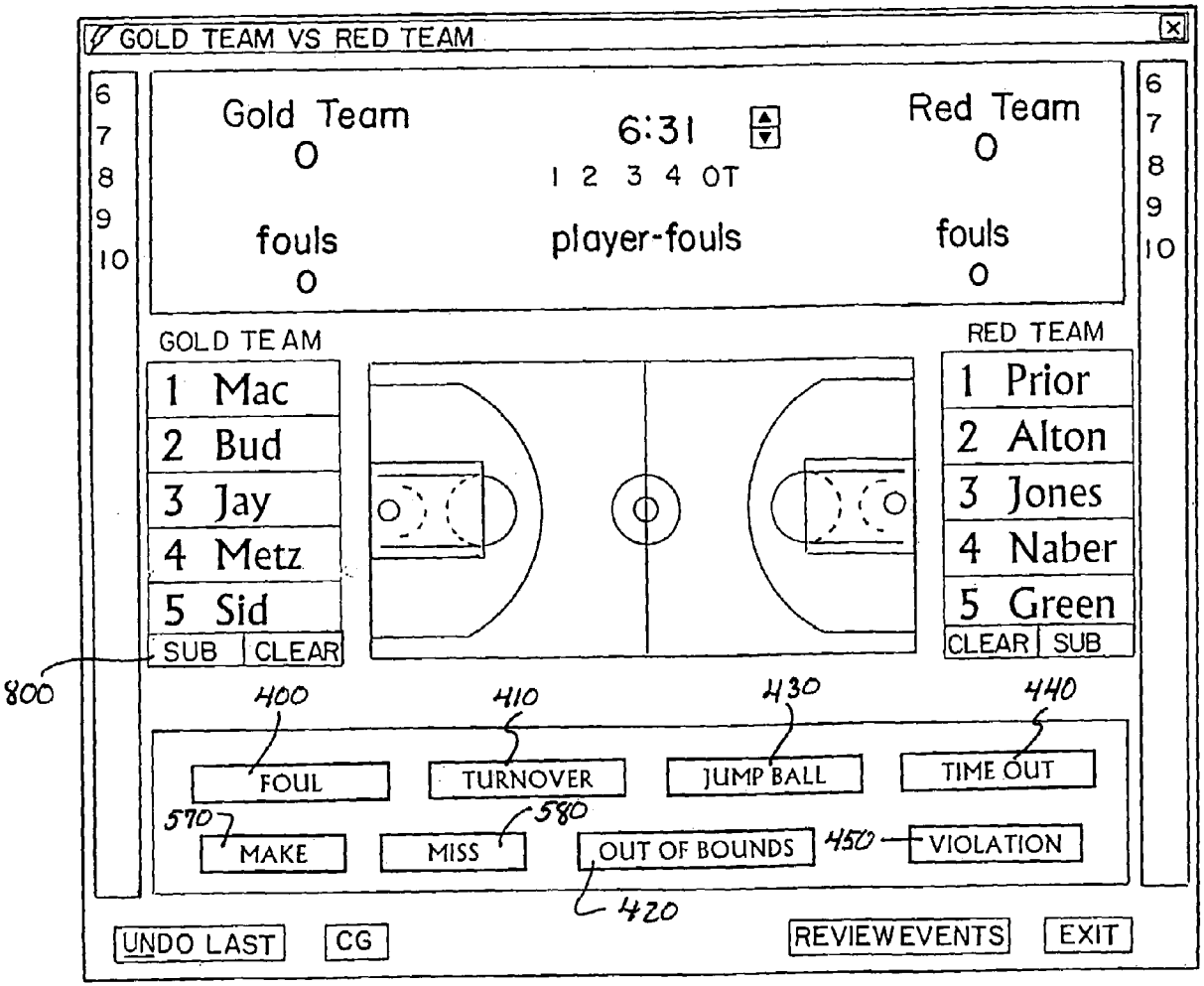
FIG. 11 is a representative Whistle Screen display of the system for one embodiment of the invention as used during a basketball game.
Figure 12A:
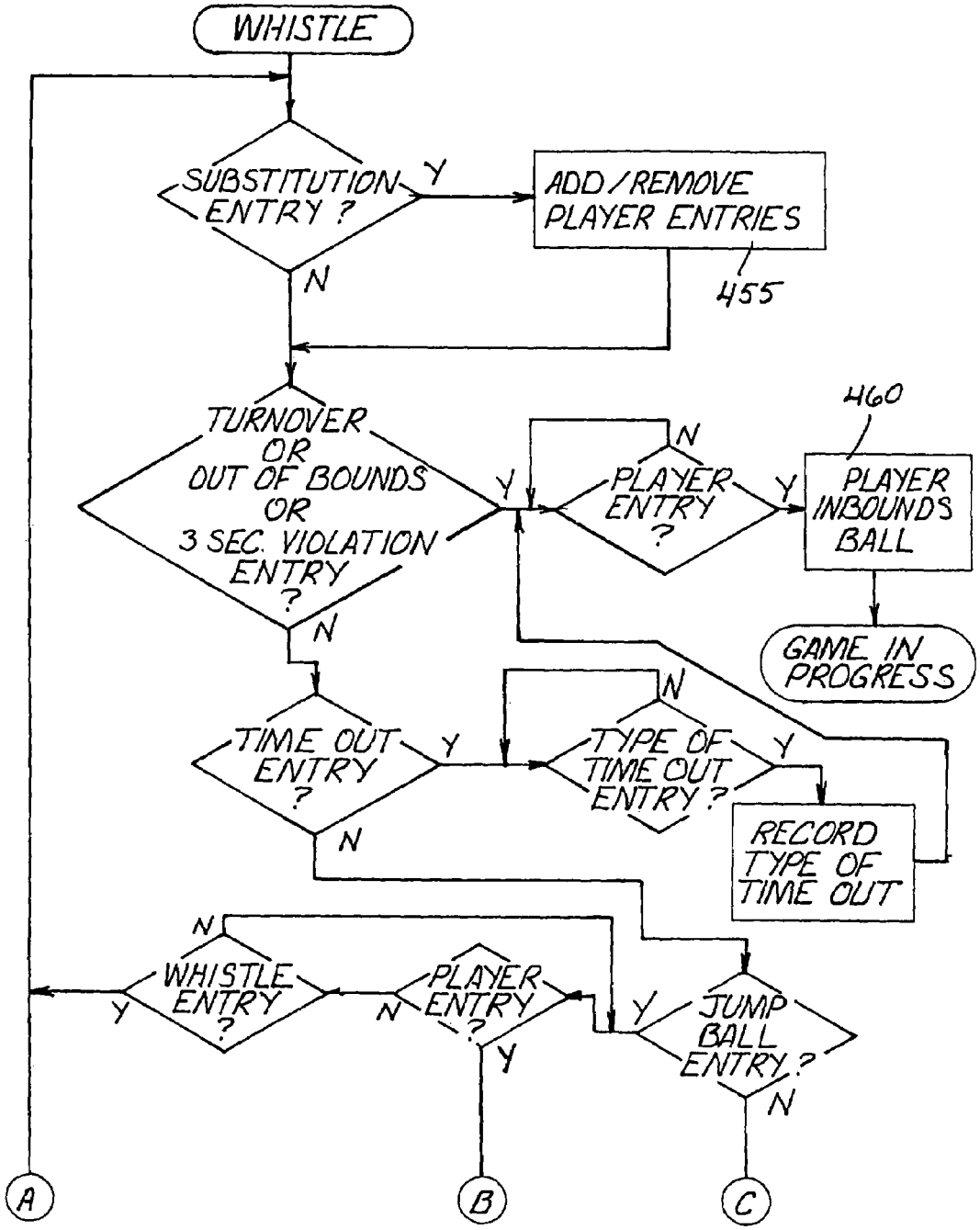
FIGS. 12A and 12B depict an embodiment of a Whistle flow diagram for use in one embodiment of the invention as used during a basketball game.
Figure 12B:
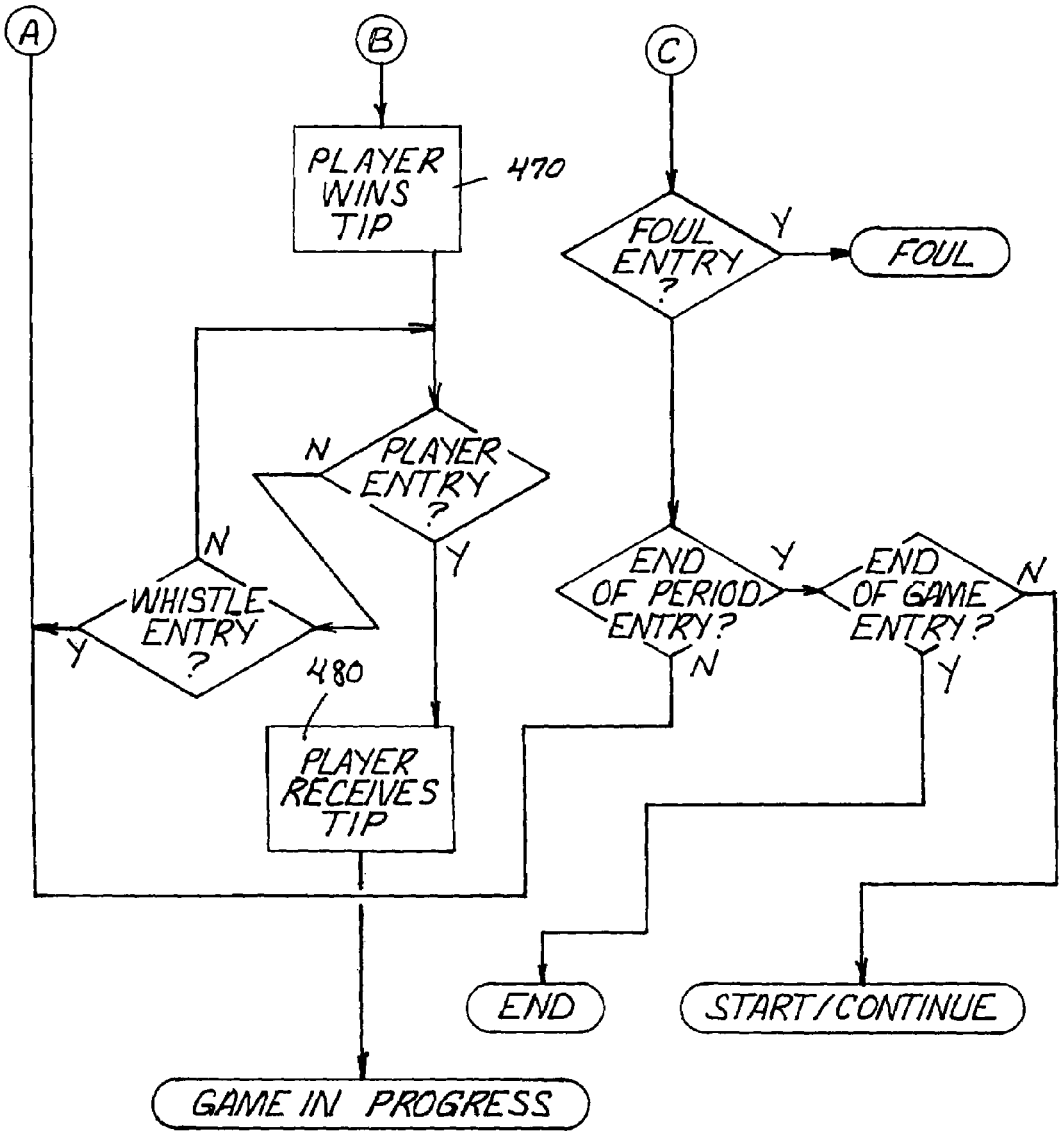

Most of the other events that occur during the course of play in a basketball game are indicated by an official's whistle. When a whistle is blown, the user selects Whistle 310 and the Game Module 20 displays the Whistle Screen as shown in FIG. 11. The system can then follow a flow like that depicted in FIG. 12 in response to a whistle. Once the game is stopped for a whistle, the system can respond to a Sub 800 entry as shown on FIG. 11 by performing the required substitution as shown in block 455. Then the user can indicate the reason for the whistle. In this embodiment, the user can choose from the following active selections: Foul 400, Turnover 410, Out of Bounds 420, Jump Ball 430, Time Out 440, and 3 Second Violation 450. If the reason for the whistle is a turnover, an out of bounds, or a 3 second violation, the user can make the appropriate selection, and the Game Module 20 can wait for a player entry. When the user selects the inbounding player, the player is given credit as the inbounding player as shown in block 460 of FIG. 12A, and then the user can continue to indicate the player in possession of the ball wherein the player in possession entries are translated into passes and turnovers as described in FIG. 8. If the reason for the whistle is a jump ball, the next player entered can be credited with winning the tip as shown in block 470 of FIG. 12B. The next player entered can be credited with receiving the tip as shown in block 480. Then the user can continue to indicate the player in possession of the ball wherein the player in possession entries are translated into passes and turnovers as described in FIG. 8.

Figure 13:
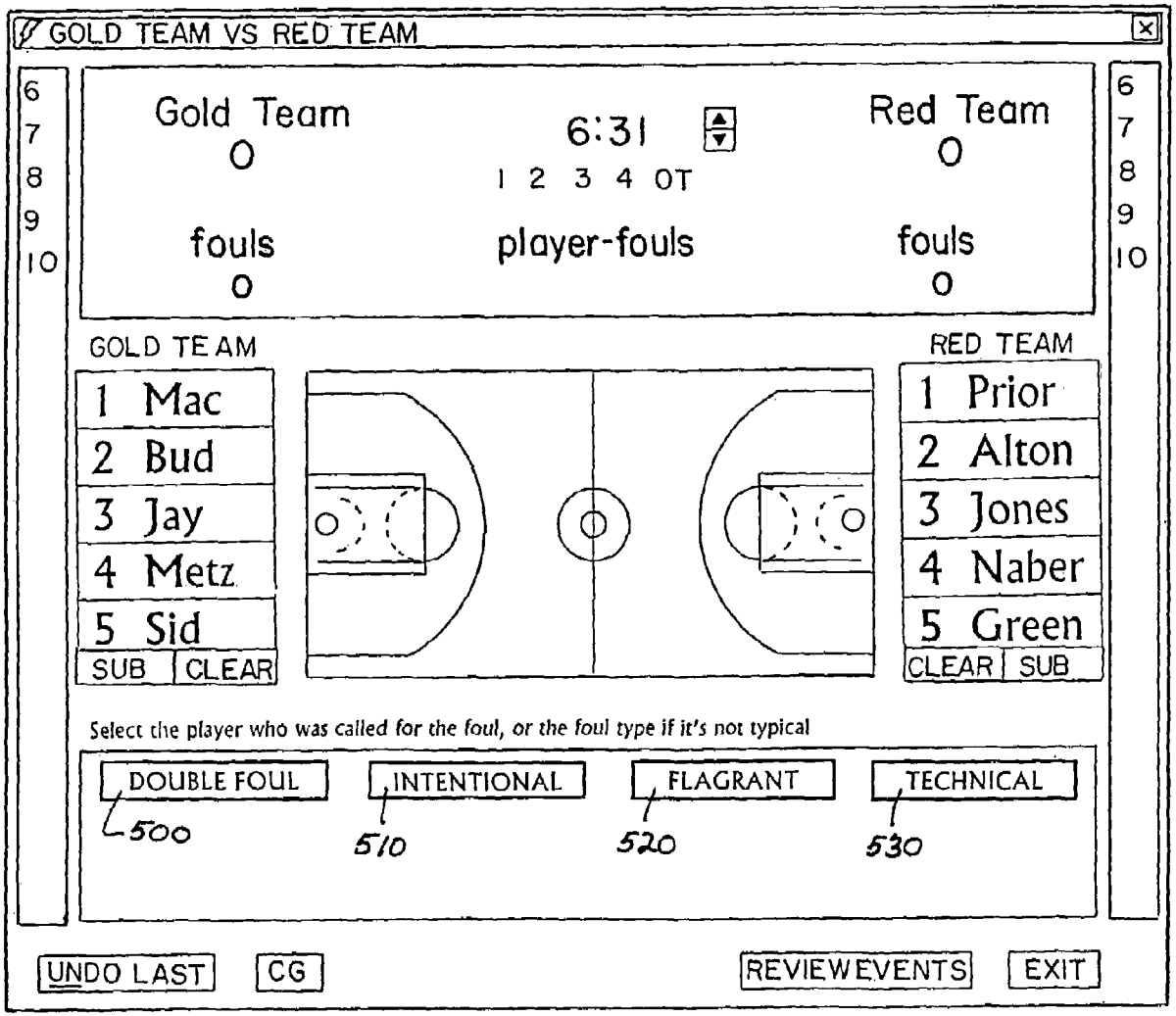
FIG. 13 is a representative Foul Screen display of the system for one embodiment of the invention as used during a basketball game.
Figure 14A:
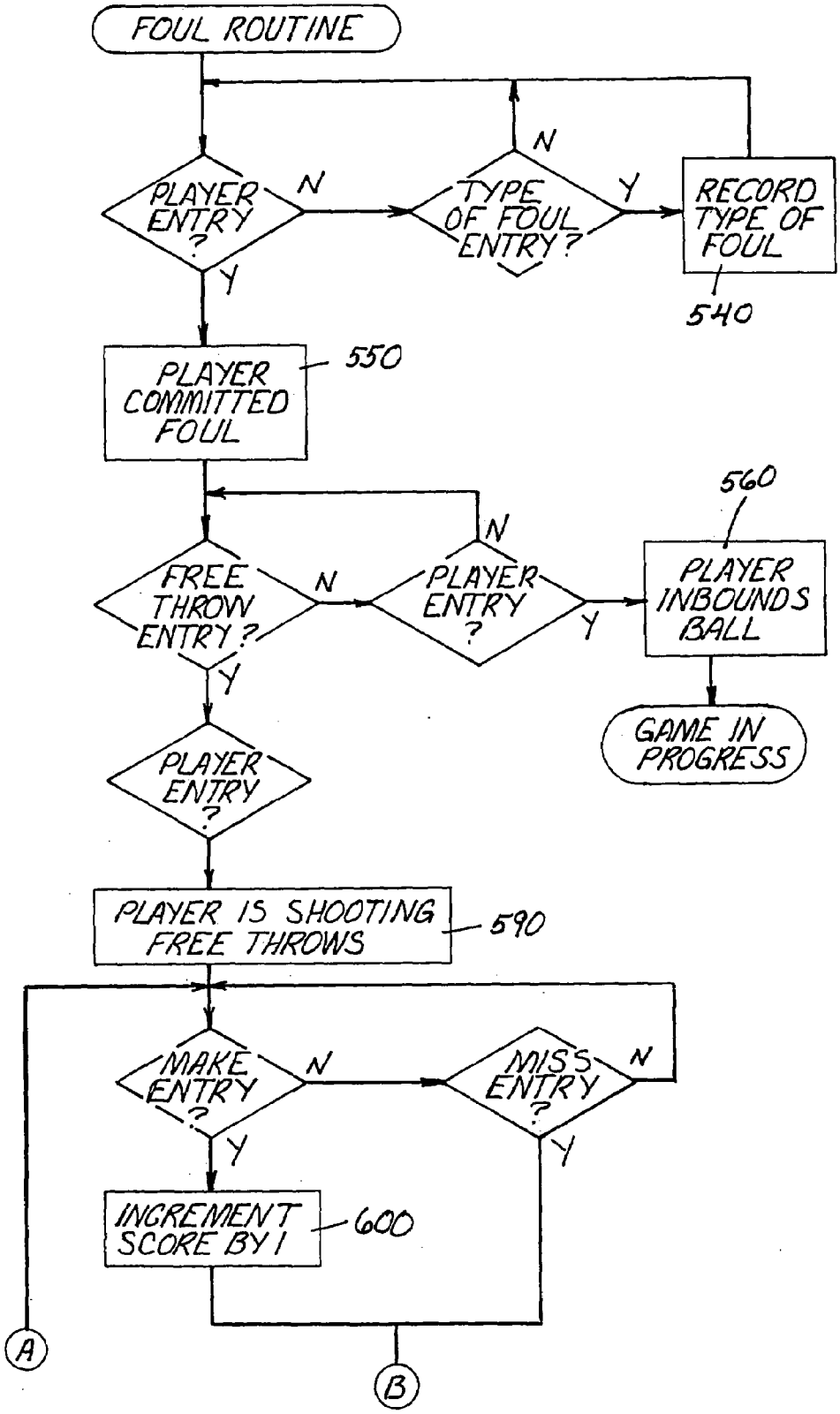
FIGS. 14A and 14B depict an embodiment of a Foul flow diagram for use in one embodiment of the invention as used during a basketball game.
Figure 14B:
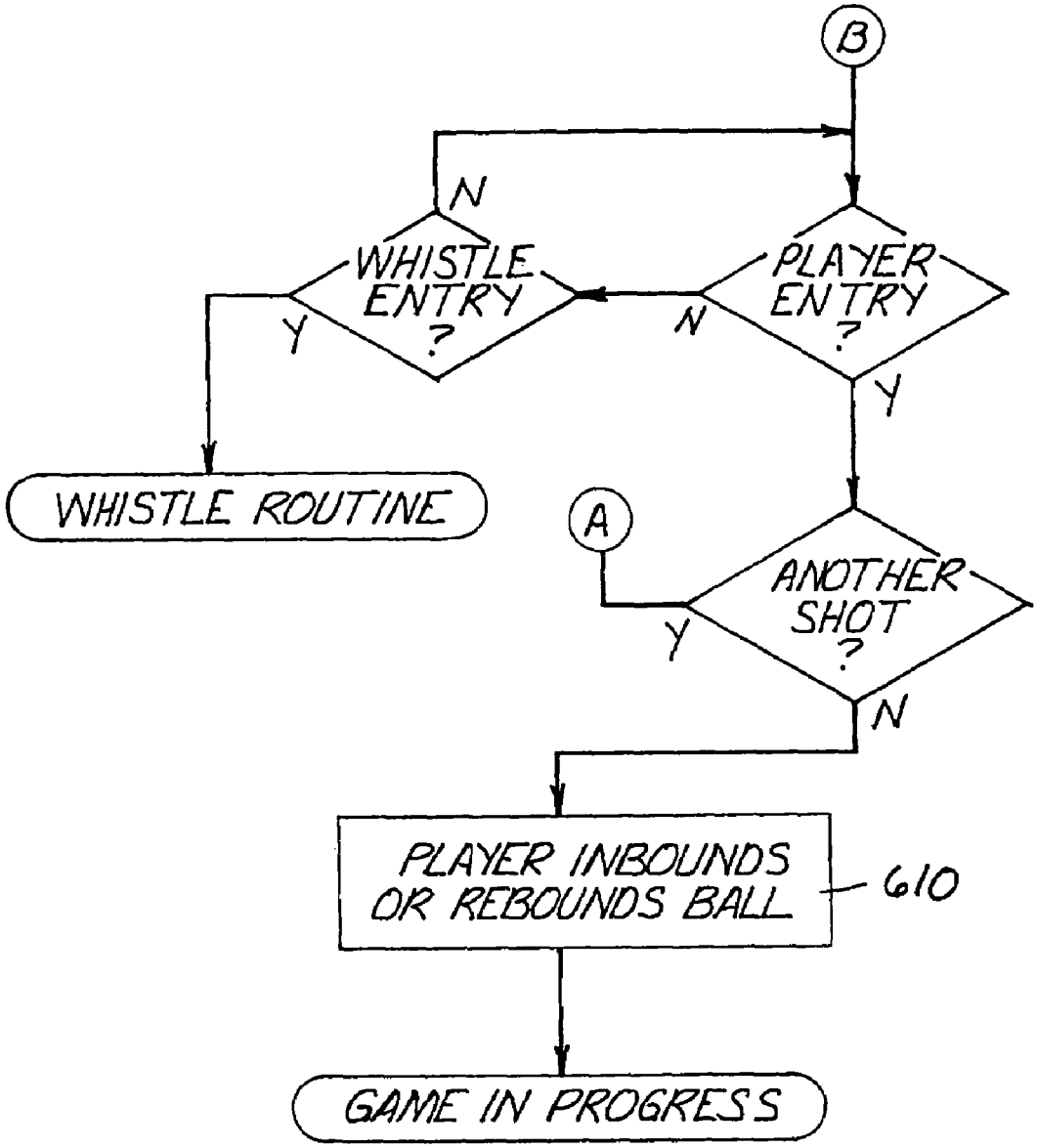

If the reason selected for the whistle is a foul, the Game Module 20 displays the Foul Screen as shown in FIG. 13. The user can select the offending player and/or the type of foul from the activated choices Double Foul 500, Intentional 510, Flagrant 520 or Technical 530 if necessary. The flow diagram of FIGS. 14A and 14B depict a process that can be followed when a foul is indicated. If the foul type is entered, it is recorded as shown in block 540, and the player entered as committing the foul is entered at block 550. If no free throws are required, the next player entered is credited with inbounding the ball as shown at block 560, and the user can continue to indicate the player in possession of the ball wherein the player in possession entries are translated into passes and turnovers as described in FIG. 8. If the foul results in free throws, the Game Module 20 can activate the selections Make 570 and Miss 580 on the Whistle Screen display as shown in FIG. 11. The next player entered is recorded as shooting the free throws as shown in block 590. The user can select the Make 570 or Miss 580 result for the free throw and the score is incremented, if necessary, as shown in block 600. After the last shot, the next player entered is credited with a rebound or with inbounding the ball as shown in block 610 (depending on whether the shot was made or missed). Then the user can continue to indicate the player in possession of the ball wherein the player in possession entries are translated into passes and turnovers as described in FIG. 8.

Figure 15:
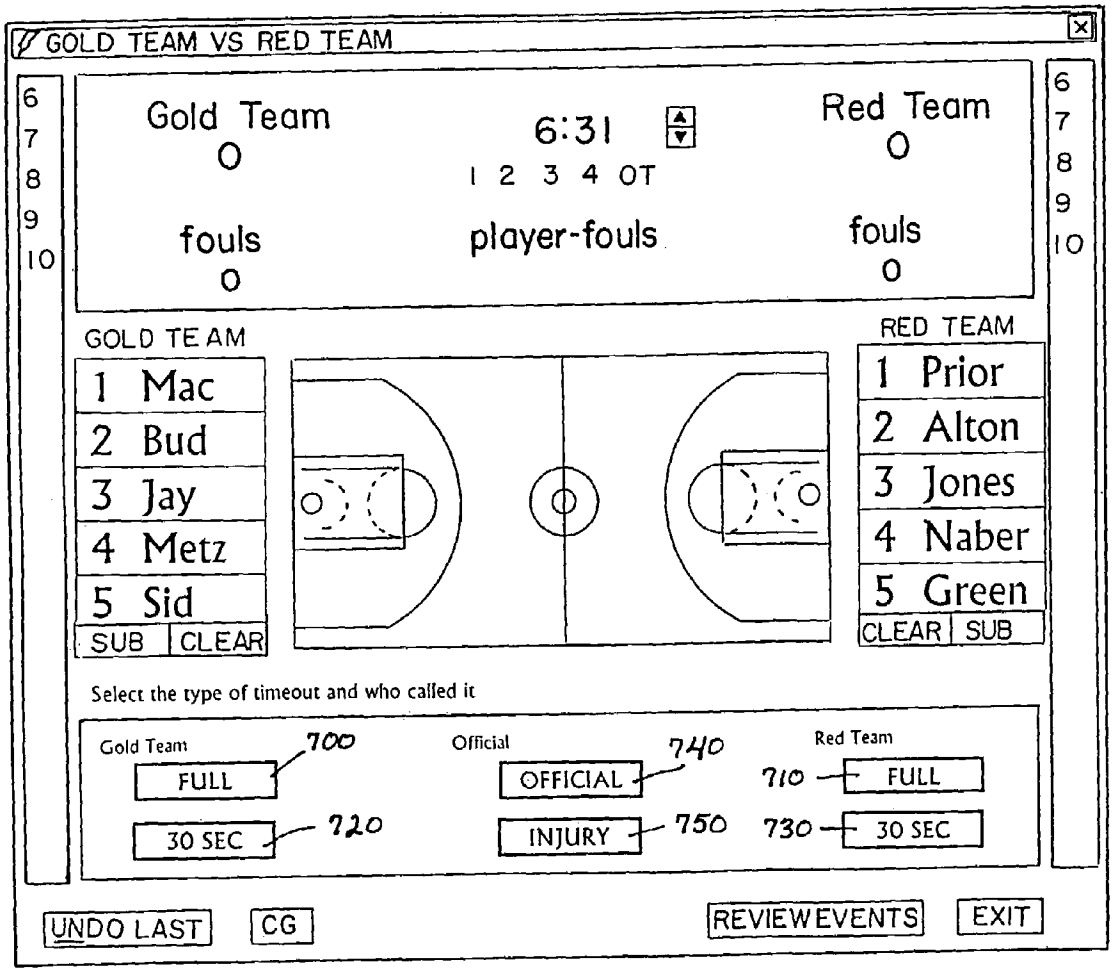
FIG. 15 is a representative Time Out Screen display of the system for one embodiment of the invention as used during a basketball game.

If the whistle is sounded for a time out, the Game Module 20 displays the Time Out Screen as shown in FIG. 15. The user can record the type of time out and who requested the time out on the User Interface 10. The selections can include Full 700, 710 and 30 Second 720, 730 for each team, Official 740 and Injury 750. Once play resumes the user can continue to indicate the player in possession of the ball wherein the player in possession entries are translated into passes and turnovers as described in FIG. 8.

Using this system, substitutions can be effectuated in a different manner and require less effort than traditional methods of data collection. When a substitution occurs during the game, the user can indicate which substitute player 105, 115 will leave the bench and enter the game, using the Sub 800 selection as shown on FIG. 3 (and most of the other screens). Each substitute player indicated can be entered into the game, and the name or number will appear in the active player area 100, 110 on the side of the court graphic 120. The user can indicate which of the active players is leaving the game, or because the system tracks players in possession of the ball, the user can allow the system to determine which players have been removed from the game. For example, if three substitute players were entered into the game without indication of the players leaving the game, eight player names and numbers would appear in the active player area 100, 110 on the side of the court graphic 120. The user can continue entering the player in possession of the ball information, along with any shot attempts or whistles. Once five of the eight players have had possession of the ball, the system can place the names and numbers of the three substituted players that have not touched the ball to the bench area 105, 115 of the display.

Figure 16:
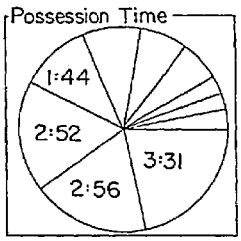
Figure 16:
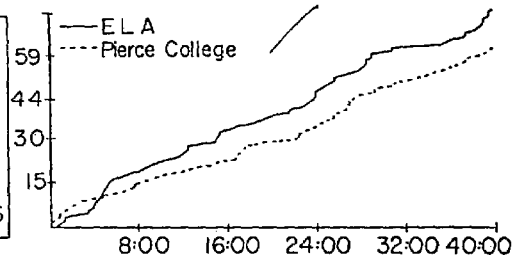
Figure 16:
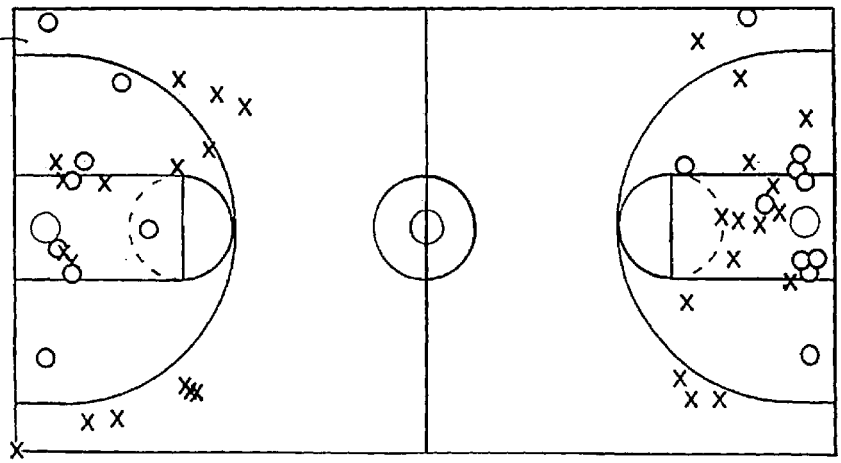
Figure 16B:
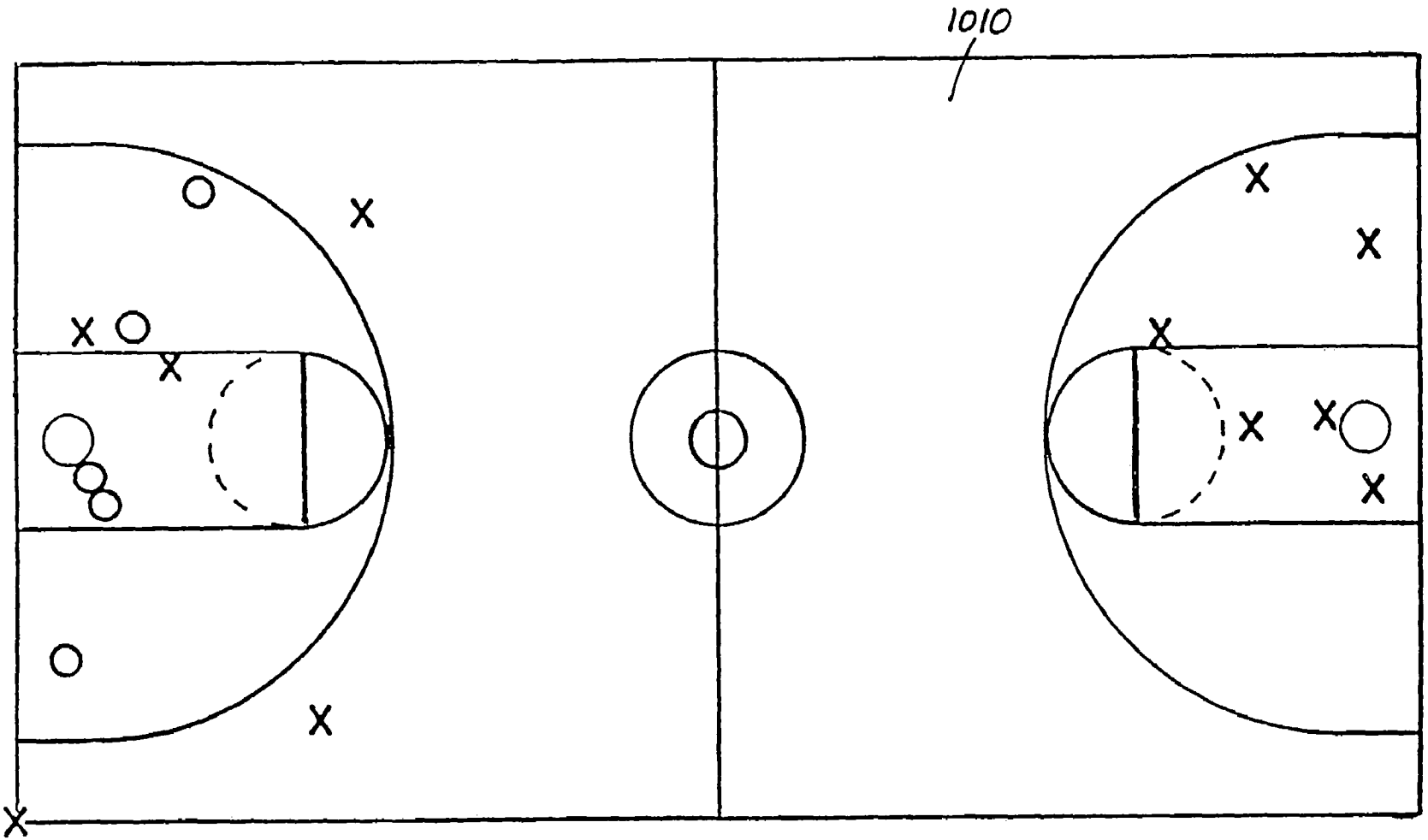
Figure 16C:
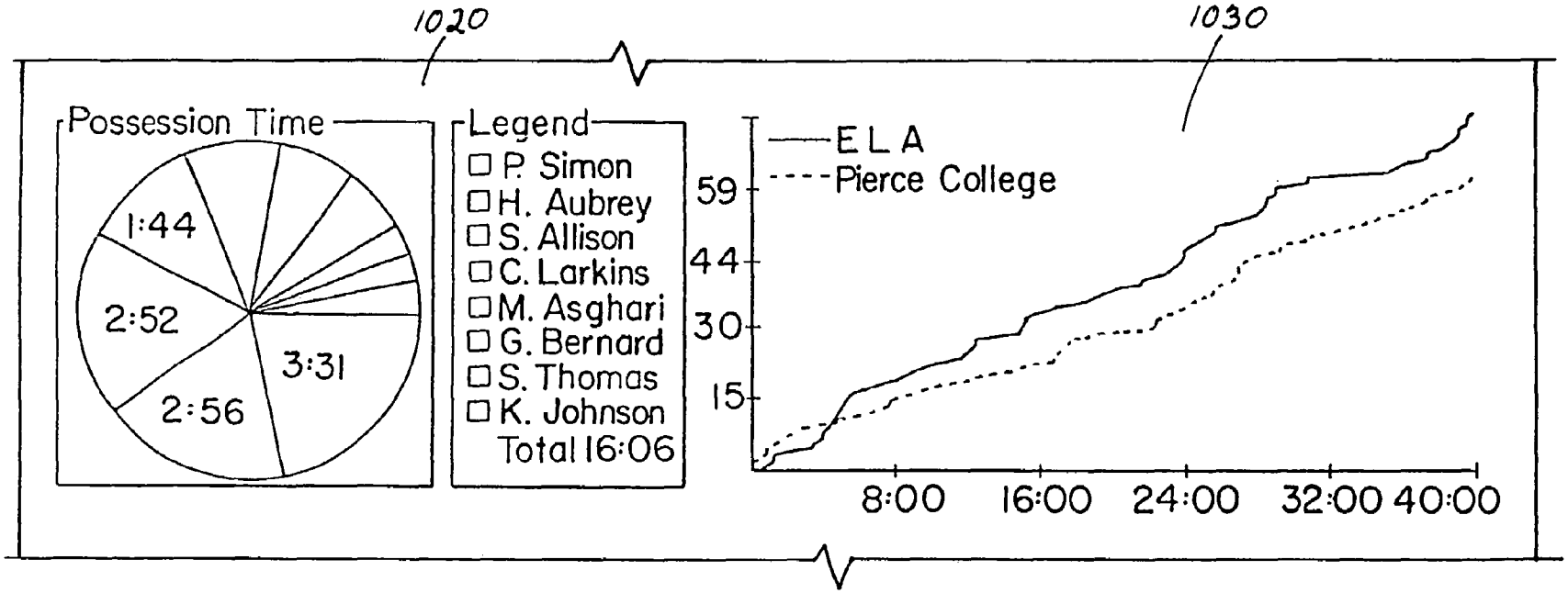

Based on entries to the Game Module 20, every event of the game can be recorded, and representative data can be stored in the game Database 30. Using the Reporting Module 50, game statistics can be computed and available in real-time throughout the game. At any point during or after the game, the system can produce a report or a graph showing shooting percentages and a shot chart for a team or for each player. Pie charts are available to show the result of each ball possession of an individual player. FIG. 16 is a sample report for a team. Standard Box statistics 1000 are available as well as a Shot Chart 1010, a Possession Time Chart 1020, and a Score Plot 1030. FIG. 16A shows a blow-up of the Standard Box statistics 1000 of FIG. 16 wherein the standard statistics regarding the basketball game can be reported. FIG. 16B shows a blow-up of the Shot Chart 1010 of FIG. 16 wherein the location and results of the shots of the team are indicated on a basketball court graphic. FIG. 16C shows a blow-up of the Possession Time Chart 1020 of FIG. 16 wherein the length of time each player had possession of the ball can be reported, and a Score Plot 1030 wherein the score at various times through the game is recorded. Using present methods for generating statistics, a Possession Time Chart 1020 is a very difficult to create, often requiring one or more task dedicated statisticians to sometimes measure only the possession time of a selected few players. The system described herein literally can track the player in possession of the ball, recording the length of time of each possession. Using this system, the possession time statistic can be readily generated and reported.

Figure 17:
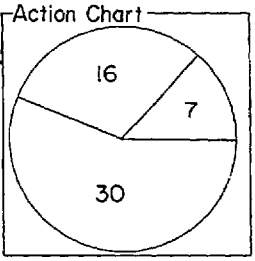
Figure 17:
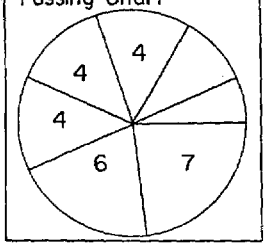
Figure 17:
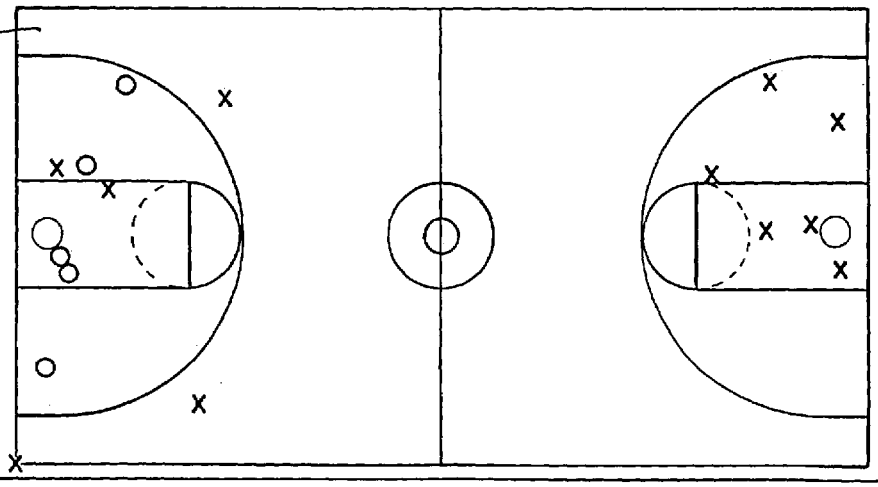
Figure 17B:
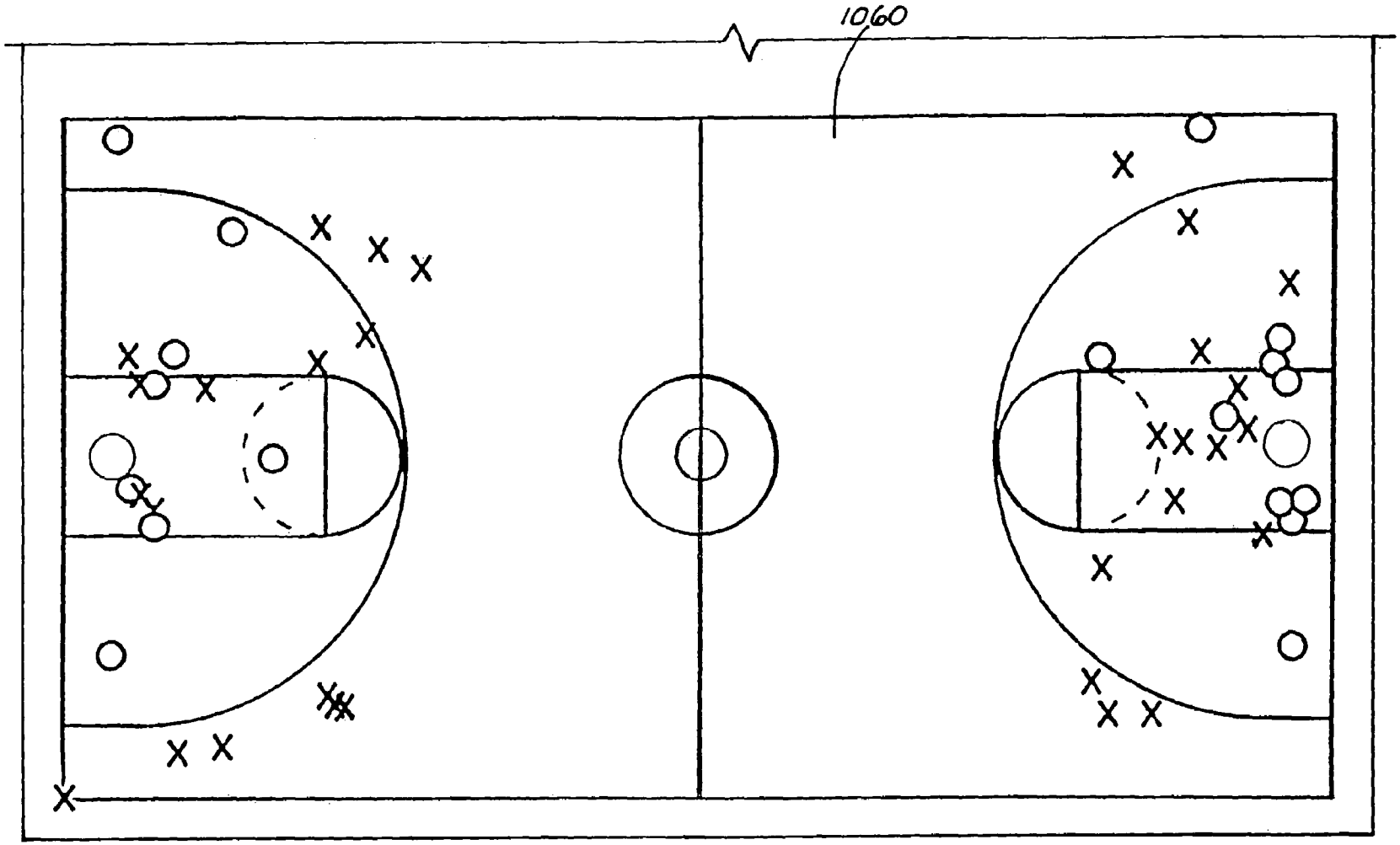
Figure 17C:
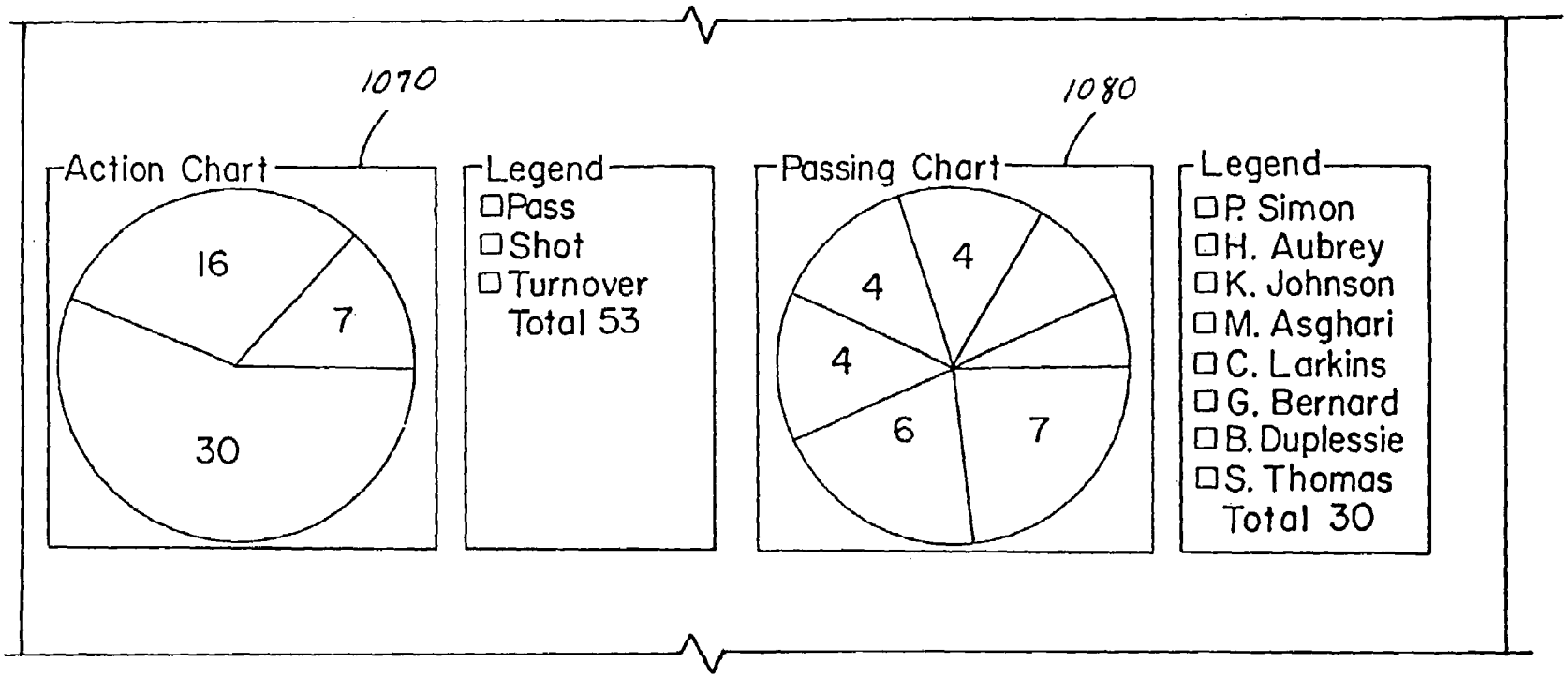

FIG. 17 is a sample report for an individual player. Standard Box statistics 1050 are available as well as a Shot Chart 1060, an Action Chart 1070, and a Passing Chart 1080. Using this system, the Reporting Module 50 can create a chart to show the result of every possession of the ball for each player. FIG. 17A shows a blow-up of the Standard Box statistics 1050 of FIG. 17 wherein the standard statistics regarding the player's performance during a basketball game can be reported. FIG. 17B shows a blow-up of the Shot Chart 1060 of FIG. 17 wherein the location and results of the shots of the player are indicated on a basketball court graphic. FIG. 17C shows a blow-up of the Action Chart 1070 of FIG. 17 wherein the result of each possession of the ball for the player can be reported. An Action Chart 1070 can report how many times a player passed, shot, and turned-over the ball, and the total number of times the player had possession of the ball. A Passing Chart 1080 can report how many times a player passed to each of his teammates, as well as the total number of passes. Using present methods for generating statistics, an Action Chart 1070 or a Passing Chart 1080 are very difficult to create, often requiring one or more task dedicated statisticians to sometimes measure only the statistics of a selected few players. The system described herein literally can track the player in possession of the ball, recording the length of time of each possession and the result of that possession.

Using this system, the action and passing statistics can be readily generated and reported.

No information of this type related to passing is known to be currently available. In addition to all standard basketball statistics, additional available statistics include a Possession Time Chart 1020, an Action Chart 1070 and a Passing Chart 1080. The passing chart represents how many times a player passes to each of the other players on the team. The action chart represents what a player does with the ball, (i.e. pass, shoot, or turnover). A user can define any type of report that uses standard statistics, the passing statistics, or a combination of both types of statistics.

The Video Search Tool 60 can be used with the Reporting Module 50 to produce even more user specific reports. This tool can record the game in time synchronization with the data collected in the Database 30. A user can identify a particular starting and end point of a game using the Video Search Tool 60 record, and request a statistical analysis of only that portion of the game.

The system can be operated by one or more users and all statistics may be available immediately. At any time during the game any of the reports may be available to be viewed on a display associated with the User Interface 10 screen, to be printed or to be sent to remote users. Reports can be generated during the game or after the game and can include all data up to the time of generating. The system can contain full records of every game for the current season and can automatically archive previous seasons. Once a game is completed, the current game statistics can be uploaded and added to the season statistics on the internet.

The Motion Module 40 and its associated hardware 45 can expand the scope of the statistics and at the same time improve the game activity entry process. The Motion Module 40 may be used in conjunction with the Game Module 20 to automate the process of taking statistics and to add information about the location of players and the primary object of play that allows the system to compile even more statistics. The additional statistics can relate to location distance and speed. The movement of the players can be tracked using radio transponders and a receiver, optical computer recognition from one or more optical cameras, an ultrasonic tracking system, an audio tracking system, a combination of theses systems or any similar or like type of system for tracking. The motion information adds an additional dimension to the statistical data that is available. With the Motion Module 40 and the Motion Module hardware 45, the system can generate statistics about how fast players are running, how far they have run, how high they have jumped, and compute an acceleration or work factor for each player.

The Reporting Module 50 can use the information from the Database 30 to compute statistical reports. Standard or user defined reports can be created. The Reporting Module 50 is designed to be user-friendly and provides comprehensive breakdowns and analyses based on user selected parameters. The Reporting Module 50 can create standard statistics and new passing statistics including: box scores, season totals by player, season totals by team, shot charts, passing charts, action charts, and a play-by-play description. The reporting options are vastly greater than the options that are generally know because the additional information regarding possession of the primary object of play is available. The data collected using the Motion Module 40 can be incorporated into the statistics reported as well. Additional team and league statistics reports can be created and made available to remote interested parties using the internet or other methods. In addition team schedules and results, team rosters, box scores, season statistics, league standings, and league statistical leaders can be made available. Information can be available to remote users or internet users as soon as new game information is uploaded from the system. Video input can be stored and synchronized with statistical data. The statistics can be enhanced by allowing the time scope of statistical reports to be selected by video browsing to certain points of a game. Furthermore, because the statistics are integrated with the data collected, the reports can allow the review of play along with the statistical data that is changing in time with the video.

Figure 18:
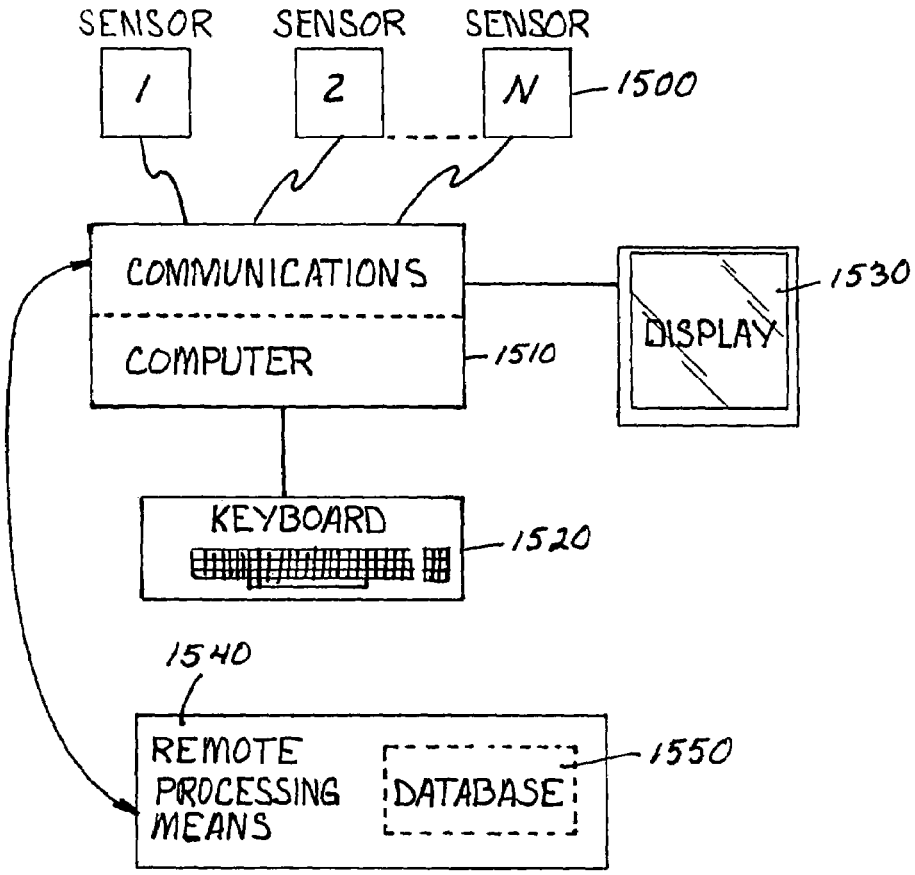
FIG. 18 depicts an alternate embodiment of the invention.
Figure 19:
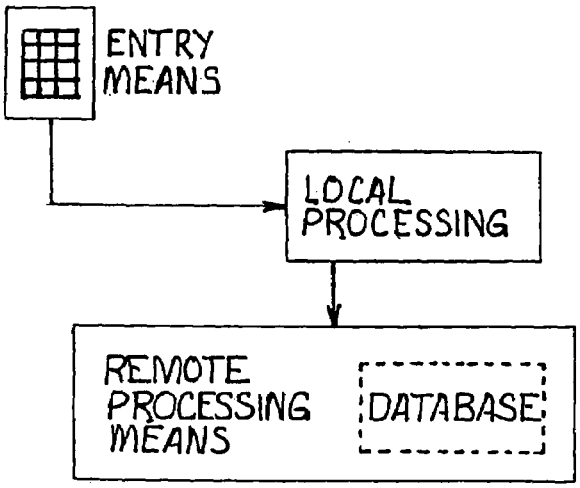
FIG. 19 depicts another alternate embodiment of the invention.

The system can reside on an individual computer or on several networked computers. A single user can enter all the game activity information or several users can each enter one or more types of game activity information. It should be noted that the embodiment described herein is an example of one use of the system. FIG. 18 depicts another possible embodiment of the system. One or more sensors 1500 are in communication with a computer 1510. A keyboard 1520 acts as a user interface, and a display 1530 can be local to the user or remote for other users. The processing means 1540 can be remotely located, as well as the database 1550. FIG. 19 depicts another possible embodiment of the present invention. An entry means 1600 and local processing 1610 can be located at the site of the sporting event. The database 1620 and software can be located at a remote processing 1630 location. Redundancy can be incorporated into the system using two or more simultaneously running versions of the system software with redundancy management software in control of the events accessible by the Game Database and the Reporting Module or by some other redundancy management technique known in the art.

It should also be noted, as with all software, the processes and functions described herein can be performed in various ways using various hardware and software languages. This description does not intend to limit the performance of these processes and functions to only the methods described herein. Many processes can be performed in a different, but equivalent manner or order than described herein without exceeding the scope of this invention.

Although the invention has been described in terms of specific embodiments and applications, persons skilled in the art can, in light of this teaching, generate additional embodiments without exceeding the scope or departing from the spirit of the claimed invention. In addition, specific features of the invention are shown in some drawings and not in others for convenience only, as each feature may be combined with any or all of the other features in accordance with the invention. Accordingly, it is to be understood that the drawings and description in this disclosure are proffered to facilitate comprehension of the invention and should not be construed to limit the scope thereof.

What is claimed is:

1. A system for real-time tracking and recording events of a sports contest with a primary object of play, the sports contest including offensive and defensive competitive interaction between at least a first team and a second team in opposition therewith, each team having at least one player, comprising:

at least one computer including a processor portion, and a user interface portion, said computer interactively operable with a user under control of a computer program associated with said processor portion thereof, a computerized database accessible through said computer program, said database including information therein indicative of recorded events of the sports contest, said computer program including a game module for controlling entry by the user of information during the sports contest, said game module operable to interpret the information regarding sports contest activities selectably entered by the user, said computer programmed for:

a. receiving from said user interface, one or more types of possession input related to a plurality of events of the sports contest, said possession input indicating the player in possession of the primary object of play, and said possession input identifying a particular player and being entered by the user each time a new player takes possession of the primary object of play, b. interpreting said possession input from said user interface and determining an event indicative of a change of possession of the primary object of play between the player and the new player based on said possession input, c. receiving from said user interface, one or more types of event input related to a plurality of events of the sports contest, d. interpreting said event input from said user interface, and e. storing data representative of said events based on possession input and said events based on event input in said database.

2. The system of claim 1 wherein said user interface includes a mouse.

3. The system of claim 1 wherein said user interface includes a touch sensitive screen.

4. The system of claim 1 wherein said user interface includes a stylus.

5. The system of claim 1 wherein said user interface includes an audio input.

6. The system of claim 1 wherein the system includes remotely accessible information regarding the sports contest and wherein said computer is programmed to obtain said remotely accessible information prior to commencement of the sports event and to store said information in said database.

7. The system of claim 1 wherein the computer is programmed to send information regarding the sports contest to remote computers.

8. The system of claim 1 further comprising a reporting module operable to interact with a user through said user interface to interactively access information from said database to produce reports related to said sports contest.

9. The system of claim 8 further comprising a recording portion that stores a recording of the sports contest, said recording being time synchronized with the data stored in said database.

10. The system of claim 8 wherein the reports include a length of time each of the players had possession of the primary object of play.

11. The system of claim 8 wherein the reports include a result for every time each one of the players had possession of the primary object of play.

12. The system of claim 11 wherein the result includes the events indicative of a change of possession of the primary object of play between the player and the new player.

13. The system of claim 12 wherein the result further includes scoring events, and officiating events.

14. The system of claim 8 wherein the reports include statistics related to the events indicative of a change of possession of the primary object of play between the player and at least one additional player.

15. The system of claim 8 wherein the reports are producible at a point during the sports contest and the reports include information representative of the data stored in the database up to the point of the sports contest.

16. The system of claim 1 further comprising a location sensing portion and said computer program further comprising a motion module, said location sensing portion operable to relay spatial position information related to the sports contest to said motion module, said motion module operable to translate said spatial position information into data related to the sports contest storable in said database.

17. The system of claim 1 wherein a scoring event input includes indicating information representative of a location of the player performing the scoring event.

18. The system of claim 8 wherein the reports include information representative of a location of the player at when the player performs a scoring event.

19. A system for tracking and recording events of a fast paced or timed sports contest in real-time, the sports contest including a primary object of play and offensive and defensive competitive interaction between at least a first team and a second team in opposition therewith, each team having at least one player, comprising:

at least one computer user interface including a processor portion, a display portion, and an information entry portion, said computer user interface interactively operable with a user under control of a computer program, a computerized database accessible through said computer program and said computer user interface, said computer program including a game module operable for translating a series of user inputs into a series of sports contest events, said computer user interface operable in accordance with said game module for:

a. accepting from the user at least one entry representative of information related to a plurality of events of the sports contest, the at least one entry representative of information including an officiating indication, a player in possession of the primary object of play entered when the player takes possession of the primary object of play, or an event, b. interactively responding to the at least one entry of the user and communicating therewith to establish a particular event:

1. indicative of a change of possession of the primary object of play by deducing the particular event based on one entry or a series of entries representative of the player in possession of the primary object of play, or 2. by deducing the particular event based on at least one entry representative of the player in possession of the primary object of play and a different event, c. displaying the particular event for verification by the user, d. storing the particular event in said database.

20. The system of claim 19 wherein the computer user interface is further operable in accordance with said game module for interactively responding to the at least one entry of the user and communicating therewith to establish the particular event from a third set of events by interactively eliciting and responding to additional entries representative of information related to the plurality of events from the user by displaying, for selection by the user, additional choices based on the at least one entry until the particular event is determined, or from a fourth set of events by recognizing the at least one entry as the particular event.

21. A method for tracking and recording events of a fast paced or timed sports contest in real-time, the sports contest including a primary object of play and offensive and defensive competitive interaction between at least a first team and a second team in opposition therewith, each team having at least one player, comprising the steps of:

providing at least one computer user interface including a processor portion, a display portion, and an information entry portion, said computer user interface interactively operable with a user under control of a computer program, providing a computerized database accessible through said computer program and said computer user interface, said computer program including a game module operable for translating a series of user inputs into a series of sports contest events, said computer user interface operable in accordance with said game module to perform the steps of:

a. accepting from the user at least one entry representative of information related to a plurality of events of the sports contest, the at least one entry representative of information including an officiating indication, a player in possession of the primary object of play entered when the player takes possession of the primary object of play, or an event, b. interactively responding to the at least one entry of the user and communicating therewith to establish a particular event:

1. indicative of a change of possession of the primary object of play by deducing the particular event based on one entry or a series of entries representative of the player in possession of the primary object of play, or 2. by deducing the particular event based on at least one entry representative of the player in possession of the primary object of play and a different event, c. displaying the particular event for verification by the user, d. storing the particular event in said database.

22. The method of claim 21 wherein the computer user interface is further operable in accordance with said game module for interactively responding to the at least one entry of the user and communicating therewith to establish the particular event from a third set of events by interactively eliciting and responding to additional entries representative of information related to the plurality of events from the user by displaying, for selection by the user, additional choices based on the at least one entry until the particular event is determined, or from a fourth set of events by recognizing the at least one entry as the particular event.

* * * * *